US009844857B2

(12) United States Patent
Skodje et al.

(10) Patent No.: US 9,844,857 B2
(45) Date of Patent: Dec. 19, 2017

(54) LOCKING PLIERS WITH HANDLE LOCKING MECHANISM

(71) Applicant: STANLEY BLACK & DECKER, INC., New Britain, CT (US)

(72) Inventors: David Skodje, West Hartford, CT (US); Tolga Caglar, Avon, CT (US); Brian Cripps, Bristol, CT (US)

(73) Assignee: Stanley Black & Decker, Inc., New Britain, CT (US)

( * ) Notice: Subject to any disclaimer, the term of this patent is extended or adjusted under 35 U.S.C. 154(b) by 314 days.

(21) Appl. No.: 14/689,946

(22) Filed: Apr. 17, 2015

(65) Prior Publication Data

US 2015/0273664 A1 Oct. 1, 2015

Related U.S. Application Data

(63) Continuation-in-part of application No. 13/360,506, filed on Jan. 27, 2012, now Pat. No. 9,027,447.

(51) Int. Cl.
*B25B 7/12* (2006.01)
*B25B 7/14* (2006.01)

(52) U.S. Cl.
CPC ..... *B25B 7/123* (2013.01); *B25B 7/14* (2013.01)

(58) Field of Classification Search
CPC .. B25B 7/123; B25B 7/00; B25B 7/02; B25B 7/04; B25B 7/10; B25B 7/12; B25B 7/14
See application file for complete search history.

(56) References Cited

U.S. PATENT DOCUMENTS 2,532,659 A 12/1950 Burns
2,539,865 A 1/1951 Sarvie
2,643,567 A 6/1953 Johnson
2,853,910 A 9/1958 Peterson
4,889,021 A 12/1989 Morrison
4,889,022 A 12/1989 Peviani
5,014,578 A 5/1991 Flentge
5,052,251 A 10/1991 Mills
(Continued)

FOREIGN PATENT DOCUMENTS

WO WO 92/03260 3/1992
WO WO 97/02926 1/1997

OTHER PUBLICATIONS

Extended European Search Report, including the Search Opinion, as issued for European Patent Application No. 13152679.0, dated May 2, 2013.

*Primary Examiner* — David B Thomas

(74) *Attorney, Agent, or Firm* — Pillsbury Winthrop Shaw Pittman LLP

(57) ABSTRACT

A pair of pliers includes an upper structure, a lower structure including a lower handle, an over center linkage, and a lock member. The lock member is movable between a locking configuration and a release configuration. When the lock member is in the locking configuration, it prevents pivoting movement of the lower handle from a closed configuration and retains jaws of the pliers in a closed position. When the lock member is in the release configuration, it enables the lower handle to be moved away from the closed configuration and allows the jaws to move to an open position. Movement of the lock member from the locking configuration to the release configuration requires sequential movement of the lock member in a first direction and then in a second direction. The second direction is different than the first direction.

21 Claims, 20 Drawing Sheets

(56) References Cited

U.S. PATENT DOCUMENTS

| | | | |
|---|---|---|---|
| 5,197,359 | A | 3/1993 | Mills |
| 5,233,893 | A | 8/1993 | Schmidt |
| 6,199,458 | B1 | 3/2001 | Wrigley et al. |
| 6,227,080 | B1 | 5/2001 | Grayo et al. |
| 6,626,070 | B2 | 9/2003 | Peperkorn et al. |
| 6,941,844 | B2 | 9/2005 | Hile |
| 7,146,887 | B2 | 12/2006 | Hunter |
| 7,216,570 | B2 | 5/2007 | Seber et al. |
| 7,762,162 | B2 | 7/2010 | Phillips, Sr. et al. |
| 8,776,646 | B2 | 7/2014 | Chervenak et al. |
| 2003/0019045 | A1 | 1/2003 | Ping |
| 2006/0248990 | A1 | 11/2006 | Bertholf et al. |
| 2007/0209484 | A1 | 9/2007 | Chervenak et al. |
| 2008/0060486 | A1 | 3/2008 | Robert |
| 2010/0186558 | A1 | 7/2010 | Hile |
| 2012/0096995 | A1 | 4/2012 | Shih |

LOCKING PLIERS WITH HANDLE LOCKING MECHANISM

CROSS-REFERENCE TO RELATED APPLICATION

This application is a Continuation-in-Part of parent U.S. application Ser. No. 13/360,506, filed on Jan. 27, 2012 entitled "Locking Pliers with Handle Locking Mechanism," and claims the benefit of priority thereof. The aforementioned parent application is incorporated herein by reference in its entirety.

FIELD

The present patent application relates generally to pliers having an overcenter locking position.

BACKGROUND

Locking pliers generally rely on an "overcenter" linkage to lock the pliers into a position compressing jaws thereof against a work piece. It may be appreciated, however, that bumping or otherwise unintentionally disturbing such pliers in such an overcenter locked position may cause the pliers to spring open and disengage from the work piece. Among other things, the present application relates to preventing pliers from unintentionally moving from an overcenter locked position.

SUMMARY

According to one aspect of this present patent disclosure, a pair of pliers is provided. The pair of pliers includes an upper structure, a lower structure, an overcenter linkage, and a lock member. The upper structure includes an upper jaw and an upper handle extending from the upper jaw. The lower structure includes a lower jaw and a lower handle. The lower jaw is configured to pivot relative to the upper jaw. The lower handle is configured to pivot relative to the lower jaw. The overcenter linkage is operatively connected between the upper structure and the lower structure. The linkage biases the lower handle and the lower jaw away from the upper handle and the upper jaw, respectively, when in a jaw-opening position, and enables the lower jaw and the lower handle to be retained in a closed configuration when the linkage is in a jaw-closing position. The lock member is movable between a locking configuration and a release configuration. When the lock member is in the locking configuration, it prevents pivoting movement of the lower handle from the closed configuration and retains the jaws in a closed position. When the lock member is in the release configuration, it enables the lower handle to be moved away from the closed configuration and allows the jaws to move to an open position. Movement of the lock member from the locking configuration to the release configuration requires sequential movement of the lock member in a first direction and then in a second direction. The second direction is different than the first direction.

These and other objects, features, and characteristics of the present patent application, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. In one embodiment of the patent application, the structural components illustrated herein are drawn to scale. It is to be expressly understood, however, that the drawings are for the purpose of illustration and description only and are not a limitation of the patent application. In addition, it should be appreciated that structural features shown or described in any one embodiment herein can be used in other embodiments as well. It is to be expressly understood, however, that the drawings are for the purpose of illustration and description only and are not intended as a definition of the limits of the patent application. As used in the specification and in the claims, the singular form of "a", "an", and "the" include plural referents unless the context clearly dictates otherwise.

BRIEF DESCRIPTION OF THE DRAWINGS

Features of the pliers in accordance with one embodiment are shown in the drawings, in which like reference numerals designate like elements. The drawings form part of this original disclosure in which:

FIG. 10 shows the locking pliers in the locked position, while FIGS. 11 and 12 show the locking pliers in the unlocked position;

DETAILED DESCRIPTION

Figure 1:
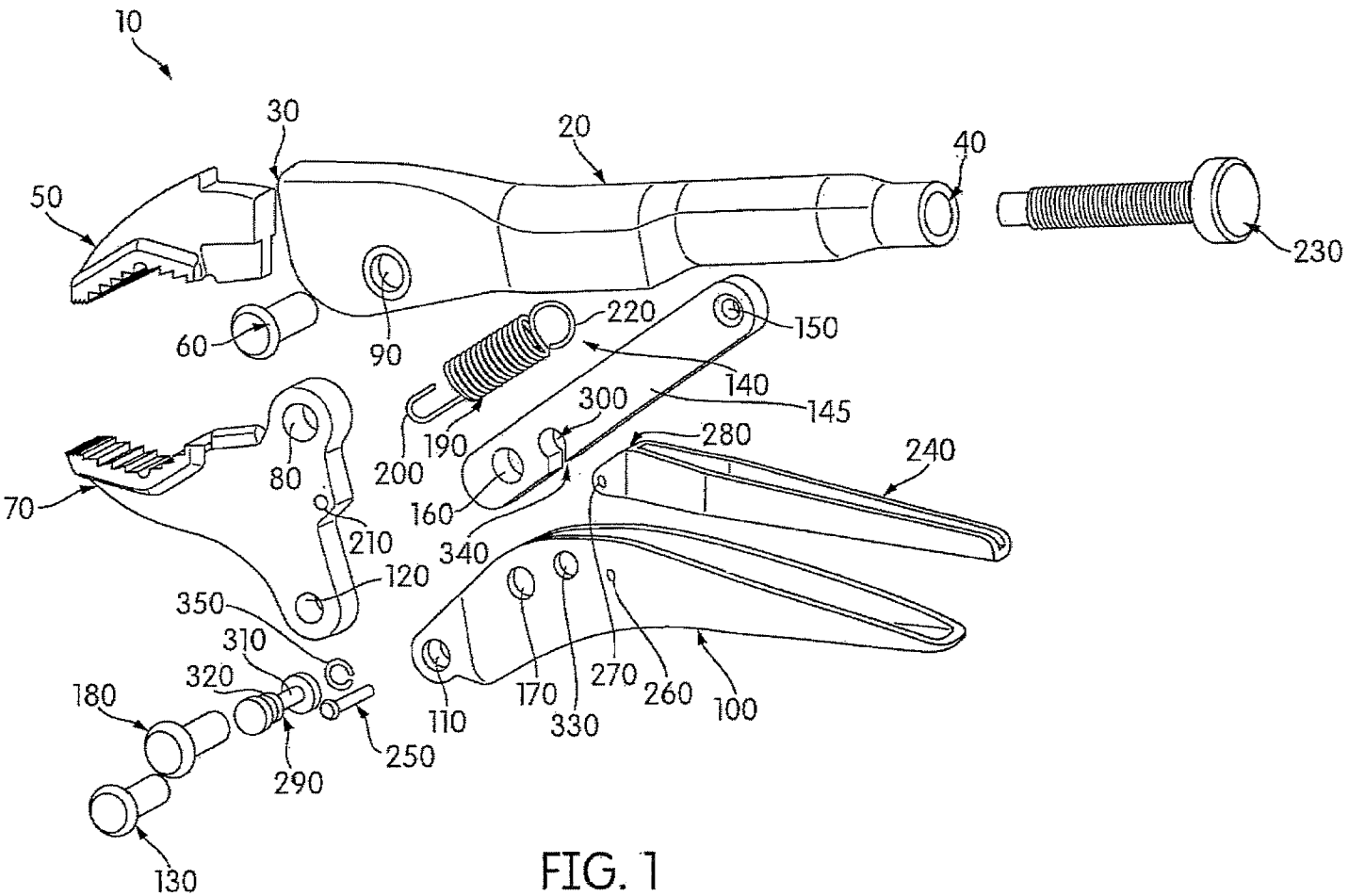
FIG. 1 is an exploded view of an embodiment of the locking pliers of the present patent application, showing the constituent components thereof.

FIG. 1 illustrates an exploded view of an embodiment of a pair of locking pliers 10 of the present patent application, wherein components thereof may be seen. The locking pliers 10 comprise an upper handle 20 that is elongated between a first end 30 and a second end 40. Received in the first end 30 is an upper jaw 50 of the locking pliers 10, forming an upper structure. As shown in the illustrated embodiment, the upper jaw 50 may be slidably received into the first end 30, and may be secured thereto by any appropriate manner, including but not limited to being welded, glued, removably or non-removably attached by one or more mechanical fasteners, or so on. In some embodiments, the upper jaw 50 may be integrally formed at the first end 30 of the upper handle 20.

Pivotally coupled to the handle 20 by a first pivot pin 60 is a lower jaw 70. As shown in the illustrated embodiment, a first pivot hole 80 of the lower jaw 70 is configured to be received in the upper handle 20, and align with corresponding upper handle pivot holes 90. The upper handle pivot holes 90 extend through the upper handle 20 (or otherwise formed on opposing faces of the upper handle 20) and have a receiving space therebetween to receive a portion of the lower jaw 70, such that the first pivot pin 60 passes through both the upper handle pivot holes 90 and the first pivot hole 80, holding the lower jaw 70 within the space between the upper handle pivot holes 90 by the first pivot pin 60. The lower jaw 70 is therefore able to pivot on the first pivot pin 60 relative to the upper handle 20 and the upper jaw 50. In various embodiments, the first pivot pin 60 may be configured as a screw, a bolt, a rivet, or any other appropriate body configured to pivotally secure the lower jaw 70 to the upper handle 20. It may be appreciated, then, that the lower jaw 70 may pivot with respect to the upper jaw 50, to open and close the jaws of the locking pliers 10.

Also pivotally coupled to the lower jaw 70 is a lower handle 100, which is elongated, to extend generally parallel to but below the upper handle 20. The lower jaw 70 and the lower handle 100 together form a lower structure. As shown, the lower handle 100 includes therein first lower handle pivot holes 110, that extend through the lower handle 100, and are configured to receive a portion of the lower jaw 70 therebetween. Specifically, the lower handle 100 is configured to receive a portion of the lower jaw 70 that contains a second pivot hole 120 formed therein. A second pivot pin 130 is received by both the first lower handle pivot holes 110 and the second pivot hole 120 of the lower jaw 70, to pivotally couple the lower handle 100 and the lower jaw 70. In various embodiments, the second pivot pin 130 may be configured as a screw, a bolt, a rivet, or any other appropriate body configured to pivotally secure the lower jaw 70 to the lower handle 100.

An overcenter linkage 140 operatively connects between the upper structure and the lower structure. Specifically, the linkage includes a linkage bar 145, which is configured to move into and out of an overcenter jaw-closing position, described in greater detail below. As shown, the linkage bar 145 contains therein an upper linkage pivot 150, which is configured to be pivotally coupled to a receiving region in the upper handle 20. While in some embodiments the upper linkage pivot 150 may engage an axle defining a pivot axis in the receiving region, in other embodiments the upper linkage pivot 150 may comprise a curved shape on the linkage bar 145, where the curved shape generally surrounds a pivot axis. A lower linkage pivot hole 160 of the linkage bar 145 is configured to be received by the lower handle 100. In the illustrated embodiment, the lower handle 100 includes second lower handle pivot holes 170, surrounding a region in which the lower linkage pivot hole 160 is inserted into, so that the second lower handle pivot holes 170 are aligned with the lower linkage pivot hole 160. As such, in some embodiments the lower handle 100 may have a generally U-shaped cross section. A third pivot pin 180 may therefore be inserted through both the second lower handle pivot holes 170 and the lower linkage pivot hole 160, such that the linkage bar 145 couples the lower handle 100 to the upper handle 20, and may push or pull on the assembly of the lower handle 100 and the lower jaw 70 to move the locking pliers 10 into and out of a relaxed jaw-opening position, a top-dead-center position, and the overcenter jaw-closing position, as described in greater detail below.

Further coupling the lower jaw 70 and the upper handle 20 as part of the linkage 140 may be a spring 190 having a first end 200 that is received in a receiving aperture 210 of the lower jaw 70, and a second end 220 that is received in the upper handle. As discussed in greater detail below, the spring 190 is configured to pull the lower jaw 70 open, which would generally bias the linkage bar 145 into the relaxed jaw-opening position. When the linkage bar 145 moves into the jaw-closing position, however, the lower linkage pivot hole 160 is positioned to the interior of the second pivot hole 120 and the upper linkage pivot 150 (i.e. proximal to the upper handle 20, resulting in any force applied between the upper jaw 50 and the lower jaw 70 act to drive the lower linkage pivot hole 160 further inward towards the upper handle 20, instead of causing the lower jaw 70 to open from the upper jaw 50, effectively locking the jaws around a work piece therebetween. As such, it may be appreciated that if the locking pliers 10 are bumped when in the overcenter jaw-closing position, the linkage may move from overcenter to top-dead-center (where the lower linkage pivot hole 160 is in alignment across the linkage bar 145 with the second pivot hole 120 and the upper linkage pivot 150), at which point the spring 190 may cause the linkage to spring into the relaxed jaw-opening position, opening the lower jaw 70 from the upper jaw 50, and releasing the work piece.

It may be appreciated that the positioning of the linkage bar 145 may be modified by an adjustment knob 230, which may be received in the handle 20, and configured to modify the position of the upper linkage pivot 150 relative to the handle 20. In the illustrated embodiment, the adjustment knob 230 is a turn-screw knob that extends from the second end 40 of the housing 20, and may screw into and out of the housing 20 to move a pivot axis of the linkage bar 145 in the handle 20 either closer to or further from the upper jaw 50. As such, the adjustment knob 230 may modify the angle of the linkage bar 145, to allow the lower jaw 70 and the upper jaw 50 to clamp down onto different sizes of work pieces, and with different amounts of force.

The pivotal coupling of the upper handle 20, lower jaw 70, lower handle 100, and linkage bar 145, as well as the coupling of the spring 190 therebetween, may generally allow the locking pliers 10 to operate through the squeezing of the lower handle 100 towards the upper handle 20. As the lower handle 100 is squeezed with a work piece between the upper jaw 50 and lower jaw 70, the linkage bar 145 may pivot to the top-dead-center position. As the lower handle 100 is squeezed further, the linkage bar 145 may move to the overcenter jaw-closing position, causing the locking pliers 10 to remain clamped onto the work piece. To provide a mechanical advantage to move the linkage bar 145 back to the top-dead-center or the relaxed jaw-opening positions, and thus release the work piece, a release lever 240 is pivotally coupled to the lower handle 100. As shown in FIG. 1, a release lever pivot pin 250 may be inserted through third lower handle pivot holes 260 formed in the lower handle 100, and through a corresponding release lever pivot hole 270 formed in the release lever 240. By lifting the release lever 240 towards the linkage bar 145, a fulcrum point 280 formed in the release lever 240 may press against the linkage bar 145 with sufficient force to bring the linkage bar 145 back out of the overcenter jaw-closing position, and back into the top-dead-center or relaxed jaw-opening positions, releasing the lower jaw 70.

As indicated above, it may be appreciated that the release spring 190 may be configured to promote the release of the lower jaw 70 and the linkage bar 145 from being locked in the overcenter jaw-closing position. As such, when the locking pliers 10 are locked around a work piece in the overcenter jaw-closing position, bumping or otherwise disturbing the locking pliers 10 may result in the linkage bar 145 slipping out of the overcenter jaw-closing position, leading to the lower jaw 70 opening away from the upper jaw 50. In such a situation, any work piece located between the lower jaw 70 and the upper jaw 50 may be inadvertently released. Additionally, the force of the spring 190 may cause the locking pliers 10 to spring away from the work piece and subsequently fall from where the locking pliers 10 were positioned. Such unintentional unlocking of the locking pliers 10 may also occur where a user of the locking pliers 10 accidently pulls on the release lever 240, moving the linkage bar 145 out of the overcenter locked position. As described in greater detail below, preventing such unintentional movements of the linkage bar 145 are an object of the present disclosure.

As shown in the exploded view of FIG. 1, a linkage latch 290 may be configured to lock the angle of the linkage bar 145 in place, so that the linkage bar 145 may not move out of the overcenter jaw-closing position, back into the top-dead-center or the relaxed jaw-opening positions. In the illustrated embodiment, the linkage latch 290 is configured to engage a latch receptacle 300 in the linkage bar 145. Specifically in the illustrated embodiment, the linkage latch 290 is generally formed as a cylinder having both a smaller diameter region 310 and a larger diameter region 320. The linkage latch 290 is configured to extend through a pair of latch holes 330 formed in the lower handle 100 that are positioned to be in alignment with the latch receptacle 300 when the linkage bar 145 is in the overcenter jaw-closing position. As shown in the illustrated embodiment, the latch receptacle 300 may be formed as having a cross-sectional shape of a generally enclosed circle extending through the linkage bar 145, with a side opening 340 extending to one side of the linkage bar 145. With such a configuration, the linkage latch 290 may slidably be positioned such that either the larger diameter region 320 or the smaller diameter region 310 is within the generally enclosed circular cross-sectional shape of the latch receptacle 300. When the larger diameter region 320 is positioned in the latch receptacle 300, the linkage bar 145 surrounds the larger diameter region 320, which is unable to pass through the side opening 340, preventing the linkage bar 145 from moving out of the overcenter locked position due to the engagement between the linkage latch 290 and the latch receptacle 300. Alternatively, where the linkage latch 290 is positioned such that the smaller diameter region 310 is generally surrounded by the latch receptacle 300, the linkage bar 145 may freely move from the overcenter jaw-closing position, as the smaller diameter region 310 may pass through the side opening 340 as the linkage bar 145 moves into and out of the overcenter jaw-closing position. Further shown in FIG. 1 is a snap ring 350 that may be received on the linkage latch 290, so as to provide a tactile sensation as the linkage latch 290 is moved between a locked position (where the larger diameter region 320 is positioned in the latch receptacle 300), and an unlocked position (where the smaller diameter region 310 is positioned in the latch receptacle 300).

Figure 2:
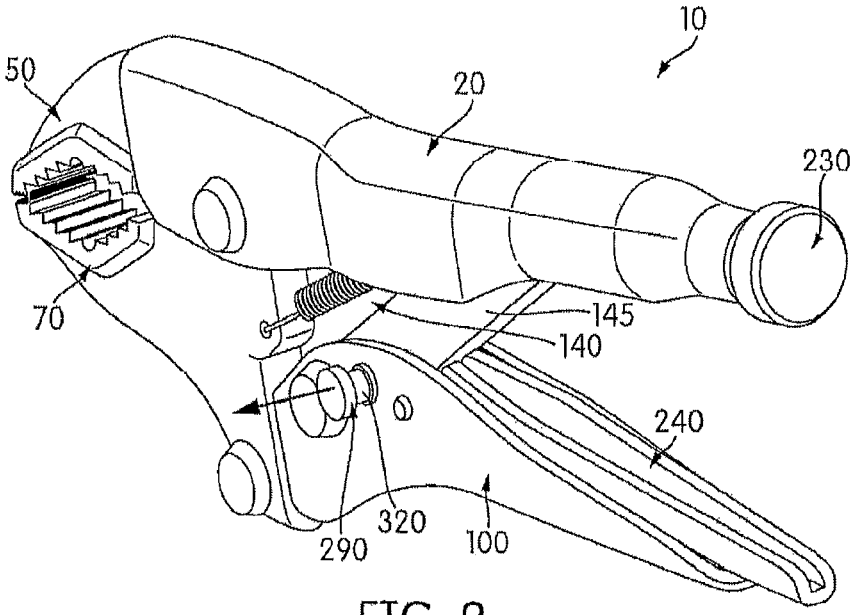
FIG. 2 is a perspective view of the embodiment of FIG. 1, showing the locking pliers in an unlocked position, whereby the locking pliers may move into and out of an overcenter locked position.
Figure 3:
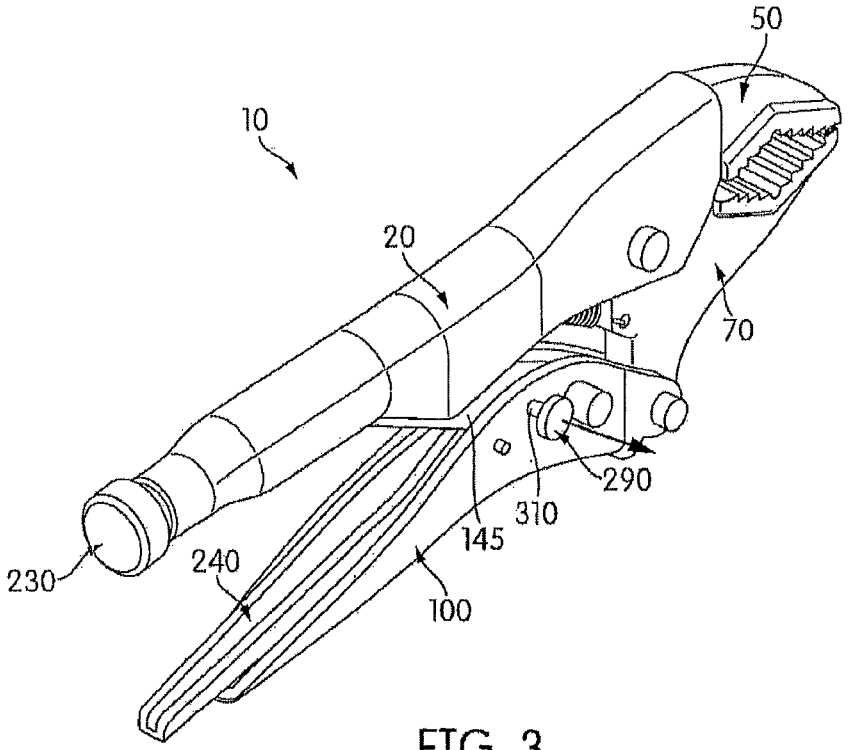
FIG. 3 is another perspective view of the embodiment of FIG. 1, showing the locking pliers in a locked position, whereby the locking pliers are prevented from moving out of the overcenter locked position.

FIGS. 2 and 3 depict perspective views of the locking pliers 10 as assembled. Specifically, FIG. 2 illustrates the locking pliers 10 where the linkage latch 290 is in the unlocked position, such that the linkage bar 145 may freely move into and out of the overcenter position. Accordingly, the smaller diameter region 310 (obscured in FIG. 2) is positioned to be in the plane of movement of the side opening 340 as the linkage bar 145 moves between the overcenter, top dead center, and relaxed jaw-opening positions. The larger diameter region 320 thus protrudes from the lower handle 100 when the locking pliers are not latched. As shown in FIG. 3, however, when the linkage latch 290 is in the locked position, the smaller diameter region 310 may extend from the lower handle 100, while the larger diameter region 320 (obscured in FIG. 3) positioned to be within the latch receptacle 300, preventing the linkage bar 145 from moving out of the overcenter locked position by being too large to pass through the side opening 340 when the linkage bar 145 attempts to move, holding the linkage bar 145 in place.

Figure 4:
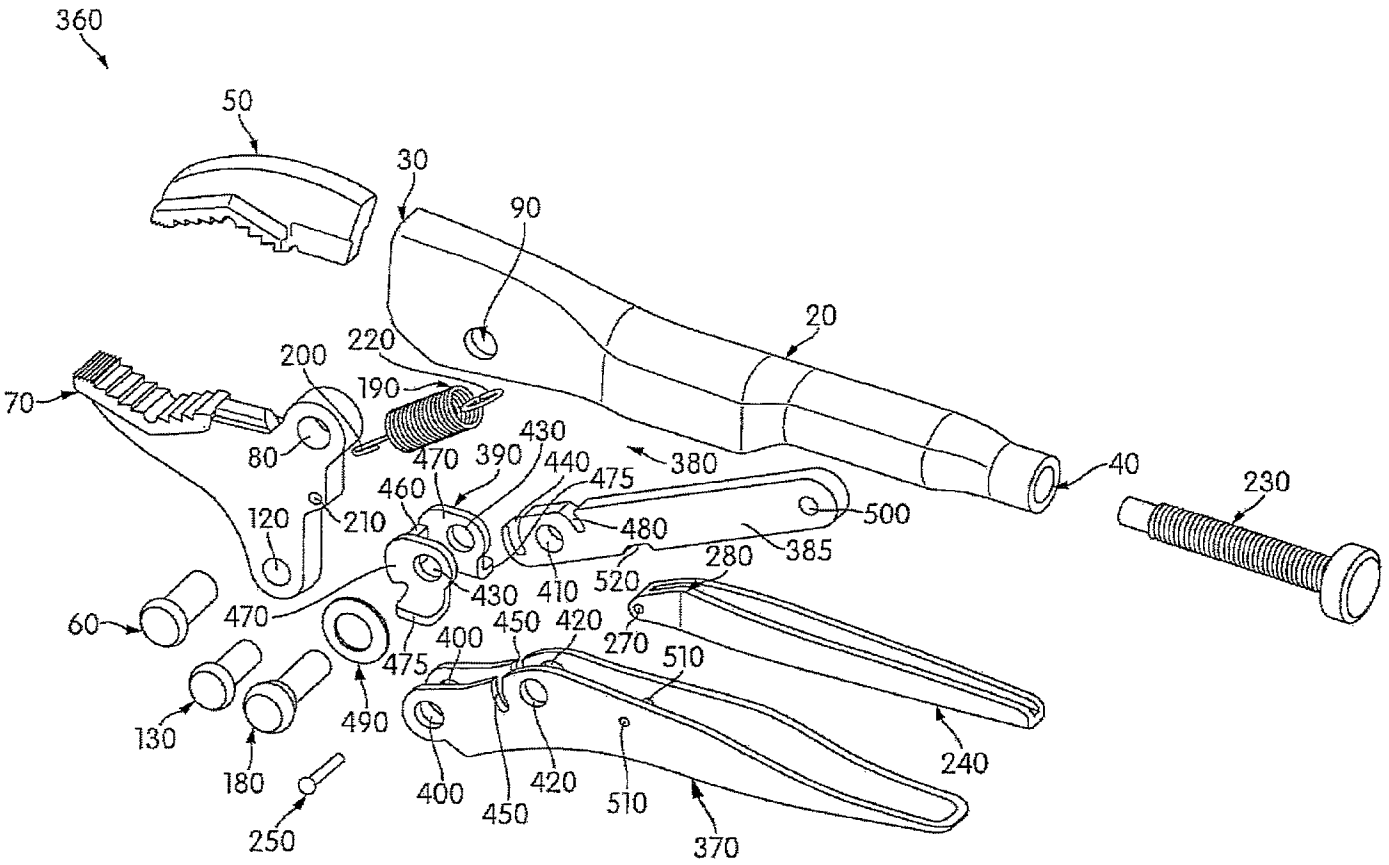
FIG. 4 is an exploded view of another embodiment of the locking pliers of the present patent application, showing the constituent components thereof.

It may be appreciated that other mechanisms for preventing movement of a linkage from the overcenter locked position are also possible, and may be utilized in other embodiments. For example, FIG. 4 depicts an exploded view of a pair of locking pliers 360 that includes a lower handle 370 and a linkage 380 with a linkage bar 385, which may be locked in place relative to one another by a pivot latch 390, as described in greater detail below. Other components of the locking pliers 360 may be similar to corresponding components of the locking pliers 10, and as such, are labeled identically to those components of the locking pliers 10 depicted in FIG. 1. For example, the locking pliers 360 include the upper handle 20 having the first end 30 and the second end 40. The upper jaw 50 is received in the first end 30, while the adjustment knob 230 is received in the second end 40. The locking pliers 360 also includes the lower jaw 70, pivotally coupled to the upper handle 20 by the first pivot pin 60, that extends through the upper handle pivot holes 90 of the upper handle 20 and the first pivot hole 80 of the lower jaw 70. Additionally, the spring 190 is coupled to the upper handle 20 and the lower jaw 70, with the first end 200 being received in the receiving aperture 210 of the lower jaw 70, and the second end 220 being received in the upper handle 20.

As shown, the lower handle 370 of the locking pliers 360 is pivotally coupled to the lower jaw 70. In particular, the lower jaw 70 is received within the lower handle 370 with first lower handle pivot holes 400 of the lower handle 370 aligned with the second pivot hole 120 of the lower jaw 70, so that the second pivot pin 130 may be inserted therethrough to pivotally couple the lower jaw 70 to the lower handle 370. The linkage bar 385 contains an associated lower linkage pivot hole 410, which is received between second lower handle pivot holds 420 of the lower handle 370. Additionally, pivot latch holes 430 of the pivot latch 390 may also be aligned with the lower linkage pivot hole 410 and the second lower handle pivot holes 420, so that the third pivot pin 180 may be inserted therethrough, pivotally coupling the lower handle 370, the linkage bar 385, and the pivot latch 390 together. With such an alignment, the pivot latch 390 may rotate about the pivot pin 180, and as such may be selectively positioned to engage both a linkage latch receptacle 440 in the pivot latch 390 and lower handle latch receptacles 450 in the lower handle 370, which would lock the linkage bar 385 to the lower handle 370, preventing movement of the linkage bar 385 from the overcenter locked position. Specifically, a pivot latch bar 460 extending between pivot latch flanges 470 containing the pivot latch holes 430 may rotate into the aligned linkage latch receptacle 440 and lower handle latch receptacles 450 when the linkage bar 385 is in the overcenter locked position, thus preventing pivotal motion between the linkage bar 385 and the lower handle 370 to move the linkage bar 385 out of the overcenter locked position. In an embodiment, such movement of the pivot latch 390 may be effectuated by manipulation of handles 475 extending from the pivot latch flanges 470 for engagement by a finger of a user of the locking pliers 360. To allow the locking pliers 360 to be subsequently unlocked, the pivot latch 390 may be rotated so that the pivot latch bar 460 disengage from the lower handle latch receptacles 450 and the linkage latch receptacle 440, disconnecting the connection between the linkage bar 385 and the lower handle 370. In the illustrated embodiment, the pivot latch bar 460 is configured to be received in a second linkage latch receptacle 480 when the pivot latch 390 is rotated so as to not interfere with the pivotal motion of the linkage bar 385.

Because the locking pliers 360 has an increased number of pivoting or otherwise rotating members about the third pivot pin 180, in the illustrated embodiment a washer 490 is additionally provided to distribute the load on the third pivot pin 180, reduce wear, or otherwise act as a spacer. It may be appreciated, however, that washers such as the washer 490 are optional, and may be found associated with the other pivot pins, or may be omitted, across various embodiments. In various embodiments, other elements of the linkage bar 385 and the lower handle 370 may generally resemble and function in a manner similar to corresponding elements of the locking pliers 10. For example, the linkage bar 385 includes an upper linkage pivot 500 which similarly to upper linkage pivot 150 would be received in the upper handle 20 at a position that is modifiable by the adjustment knob 230. Additionally, the lower handle 370 includes third lower handle pivot holes 510 that may be aligned with the release lever pivot hole 270 of the release lever 240 so that the release lever pivot pin 250 may be inserted therethrough to pivotally couple the release lever 240 to the lower handle 370. As shown in the embodiment of FIG. 4, however, in some embodiments the linkage bar 385 may include a release lever receiving region 520 configured to enhance the mechanical advantage provided by the fulcrum point 280 of the release lever 240 as it engages the linkage bar 385 to move the linkage bar 385 out over the overcenter locked position.

Figure 5:
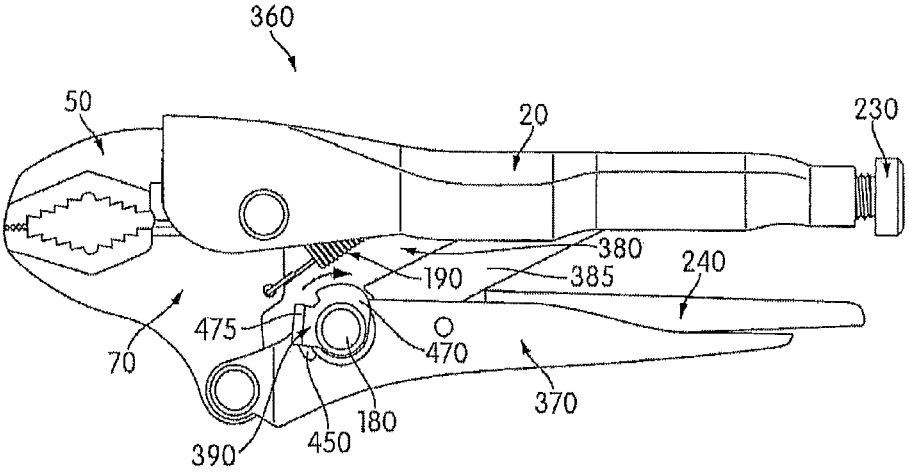
FIG. 5 is a side view of the embodiment of FIG. 4, showing the locking pliers in an unlocked position, whereby the locking pliers may move into and out of an overcenter locked position.
Figure 6:
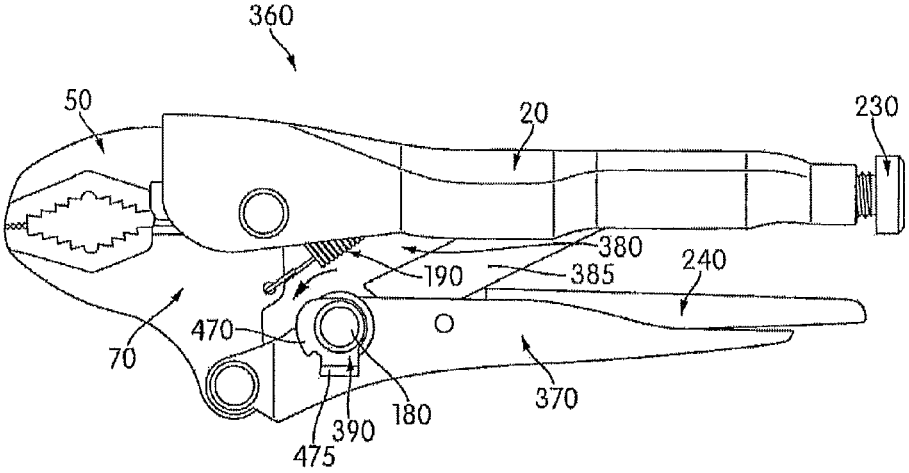
FIG. 6 is another side view of the embodiment of FIG. 4, showing the locking pliers in a locked position, whereby the locking pliers are prevented from moving out of the overcenter locked position.

FIGS. 5 and 6 depict side views of the locking pliers 360 as assembled. Specifically, FIG. 5 illustrates the locking pliers 360 where the pivot latch 390 is in the unlocked position, such that the linkage bar 385 may freely move into and out of the overcenter position. Accordingly, pivot latch bar 460 (obscured in FIG. 5) is positioned to be out of the plane of the alignment between the lower handle latch receptacles 450 and the corresponding linkage latch receptacle 440 (also obscured in FIG. 5) in the linkage bar 385, so that the linkage bar 385 may move between the overcenter, top dead center, and relaxed jaw-opening positions. Alternatively, FIG. 6 depicts the pivot latch 390 in the locked position, such that the pivot latch bar 460 is positioned in the plane of alignment between the lower handle latch receptacles 450 and the corresponding linkage latch receptacle 440, preventing the linkage bar 385 from moving relative to the lower handle 370, and thus holding the linkage bar 385 in the overcenter locked position.

Various components of the locking pliers 10, the locking pliers 360, variations thereof, or other such embodiments may each be of any suitable construction or configuration, including but not limited to being formed from metal, plastic, elastomer, wood or combinations thereof. In some embodiments, the handles (i.e. the upper handle 20 and/or the lower handles 100 or 370) may be at least partially wrapped in a grip material, including but not limited to rubber. Additionally, while in the illustrated embodiment the linkage latch 290 and the pivot latch 390 are configured to couple the linkage bars 145 or 385 to the lower handles 100 or 370, in other embodiments the linkage latch 290, the pivot latch 390, variations thereof, or other such embodiments may be configured to couple the linkages to the upper handle 20, the lower jaw 70, the upper jaw 50, or any other appropriate location of the locking pliers, so as to selectively prevent movement of the linkage from the overcenter lock position.

FIGS. 7-24 provide another embodiment of the locking pliers having a mechanism for preventing movement of a linkage of the locking pliers from an overcenter locked position.

FIGS. 7-12 depict various views of a pair of locking pliers 700 that includes a lower handle 800 and a linkage 840 with a linkage member 845, which may be locked in place relative to one another by a lock assembly 1000, as described in greater detail below. Other components of the locking pliers 700 may be similar to corresponding components of the locking pliers 10 depicted in FIG. 1, and as such, are labeled identically to those components of the locking pliers 10. For example, the locking pliers 700 includes an upper handle 720 having the first end 30 and the second end 40. An upper jaw 750 is received in the first end 30, while an adjustment knob 930 is received in the second end 40. The locking pliers 700 also includes a lower jaw 770, pivotally coupled to the upper handle 720 by a first pivot pin 760, that extends through the upper handle pivot holes 90 of the upper handle 720 and the first pivot hole 80 of the lower jaw 770. Additionally, the spring 190 (shown in FIG. 12) is coupled to the upper handle 720 and the lower jaw 770, with the first end 200 being received in the receiving aperture 210 of the lower jaw 770, and the second end 220 being received in the upper handle 720. A second pivot pin 830 is received by both the first lower handle pivot holes 110 and the second pivot hole 120 of the lower jaw 770, to pivotally couple the lower handle 800 and the lower jaw 770.

In various embodiments, some elements of the linkage member or bar 845 and the lower handle 800 may generally resemble and function in a manner similar to corresponding elements of the locking pliers 10. For example, referring to FIG. 13, the linkage member 845 includes an upper linkage pivot 500 which similarly to the upper linkage pivot 150 would be received in the upper handle 720 at a position that is modifiable by the adjustment knob 930. Additionally, the lower handle 800 includes third lower handle pivot holes 260 that may be aligned with the release lever pivot hole 270 of the release lever 940 so that a release lever pivot pin 850 may be inserted therethrough to pivotally couple the release lever 940 to the lower handle 800. In the illustrated embodiment of FIGS. 14 and 15, the lower handle 800 includes second lower handle pivot holes 170, surrounding a region in which the lower linkage pivot hole 160 is inserted into, so that the second lower handle pivot holes 170 are aligned with the lower linkage pivot hole 160. A third pivot pin 880 may therefore be inserted through both the second lower handle pivot holes 170 and the lower linkage pivot hole 160, such that the linkage member 845 couples the lower handle 800 to the upper handle 720, and may push or pull on the assembly of the lower handle 800 and the lower jaw 770 to move the locking pliers 10 into and out of a relaxed jaw-opening position, a top-dead-center position, and the overcenter jaw-closing position.

Figure 7:
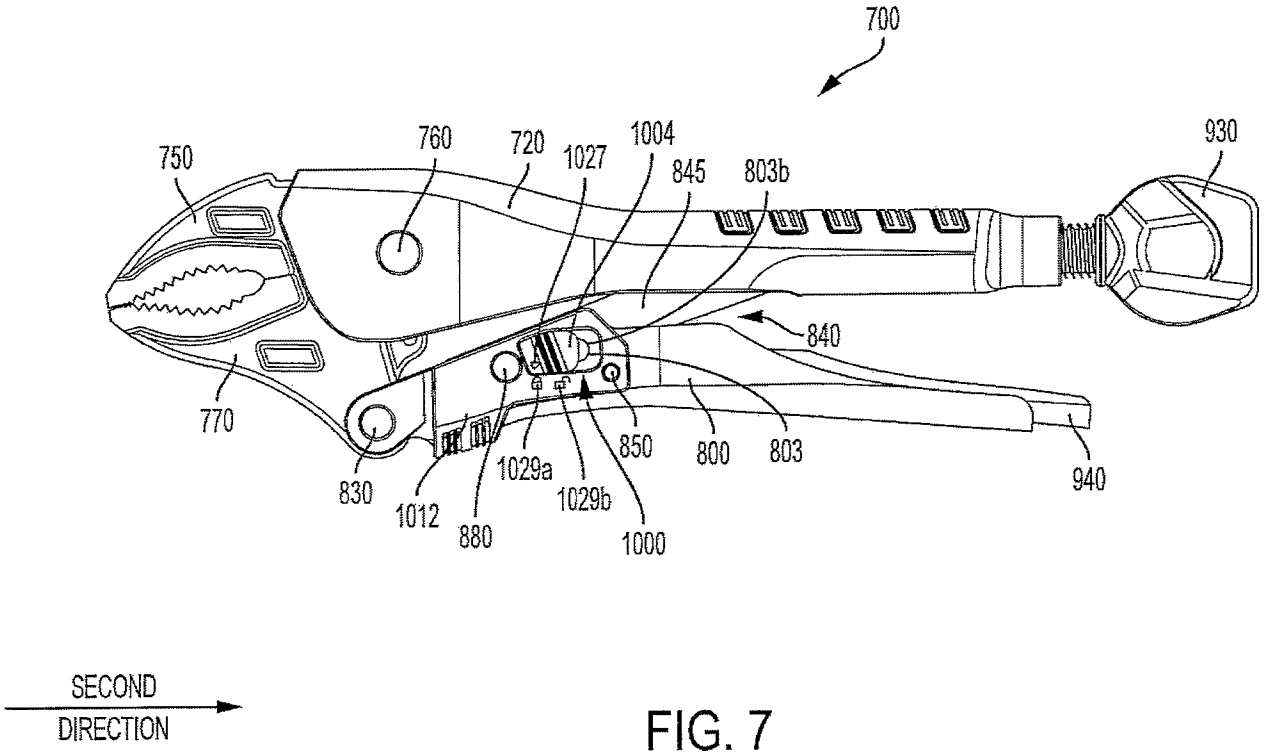
FIGS. 7 and 8 show a side elevational view and a perspective view of a locking pliers in a locked position, whereby the locking pliers are prevented from moving out of an overcenter locked position, in accordance with another embodiment of the present patent application.
Figure 8:
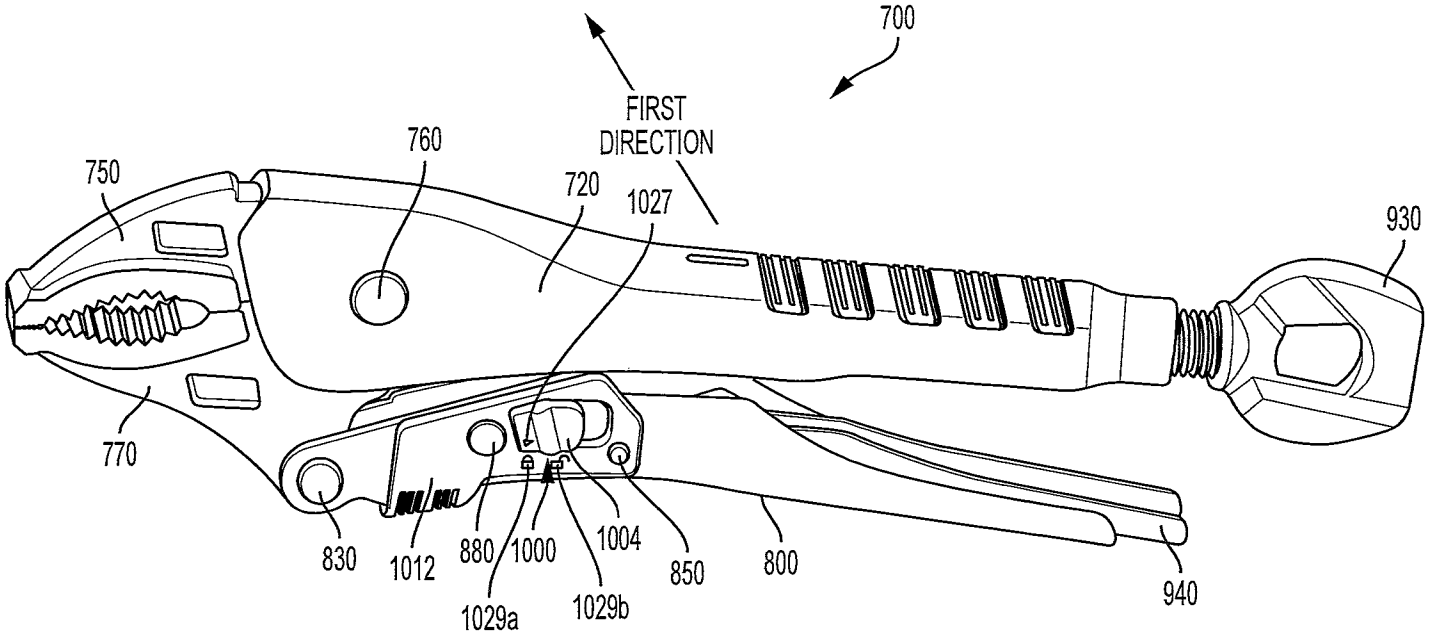
Figure 9:
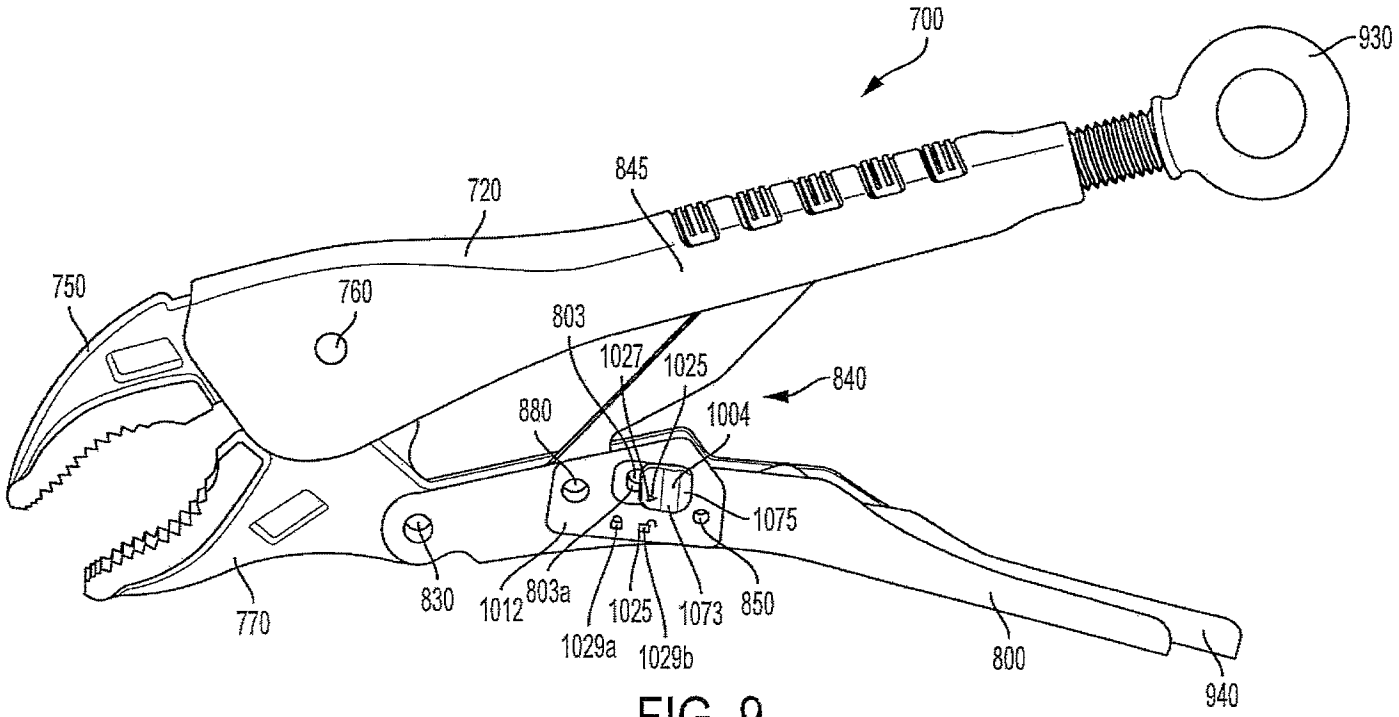
FIG. 9 is another side elevational view of the locking pliers of FIG. 7, showing the locking pliers in an unlocked position, whereby the locking pliers may move into and out of the overcenter locked position.
Figure 10:
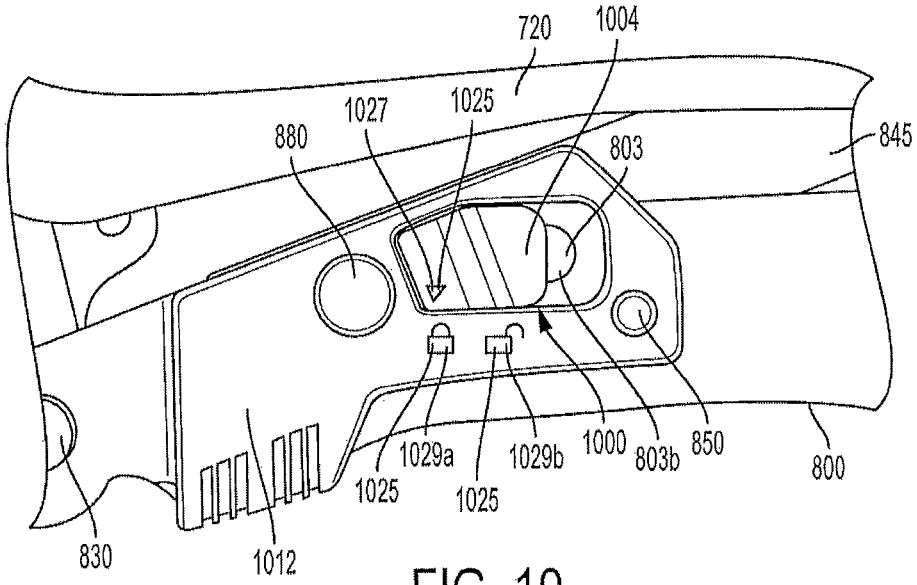
FIGS. 10, 11 and 12 show partial, close-up detailed views of the locking pliers, where
Figure 11:
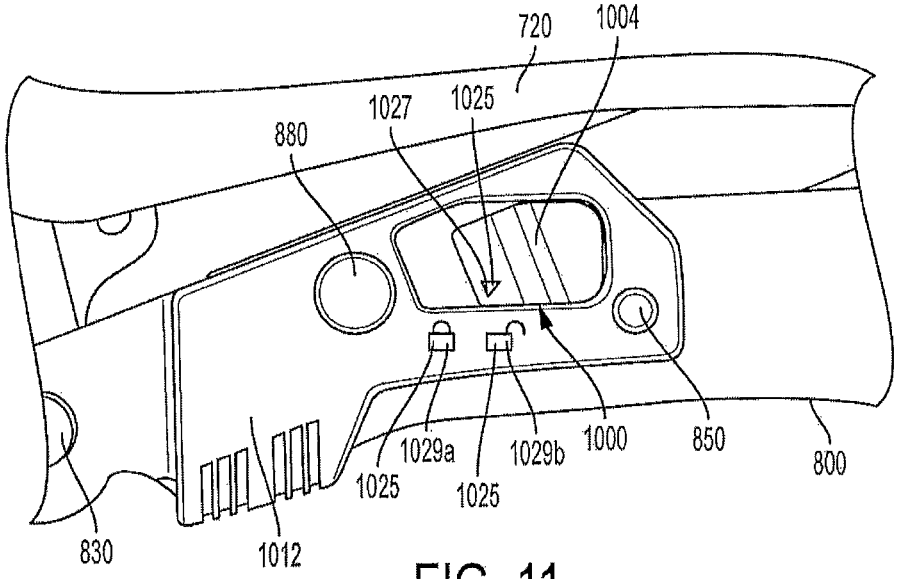
Figure 12:
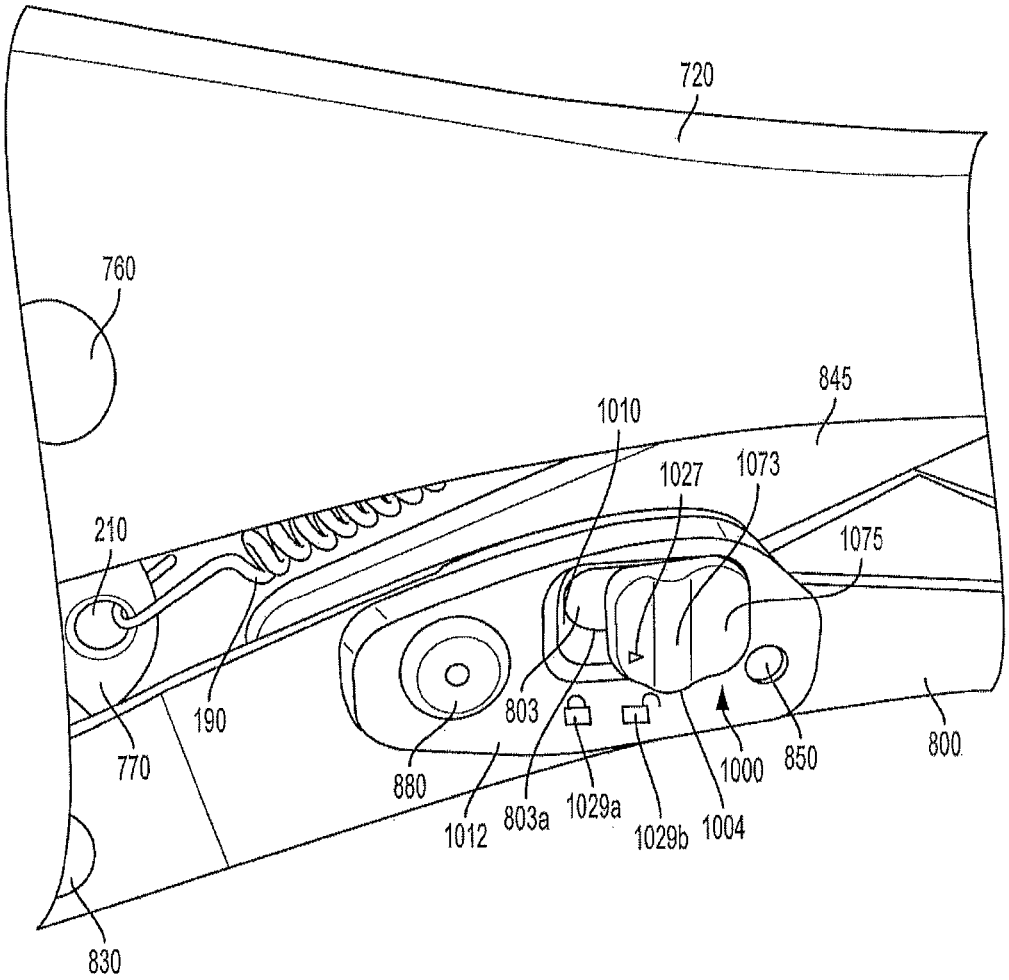
Figure 12A:
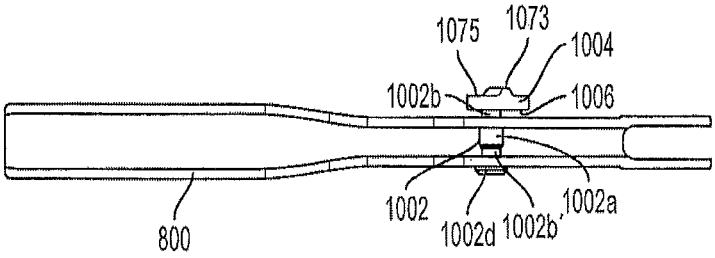
FIG. 12*a* shows a top elevational view of the locking pliers, where the locking pliers in the locked position and where some of the components or parts of the locking pliers are not shown for the sake of clarity.

In one embodiment, the lock assembly 100*o* includes a lock member 1002. In one embodiment, movement of the lock member 1002 from the locking configuration (as shown in FIGS. 7, 8 and 10) to the release configuration (as shown in FIGS. 9, 11 and 12) requires sequential movement of the lock member in a first direction and then in a second direction. In one embodiment, the second direction is different than the first direction. In one embodiment, the first direction and the second direction are perpendicular to one another.

In one embodiment, the first direction generally refers to a direction into the plane of the paper/page in FIG. 7. In one embodiment, the first direction is a direction perpendicular to a plane of the movement of the linkage 845. In one embodiment, the plane of movement of the linkage 845 is generally parallel to a plane of the paper/page, for example, in FIG. 7. In one embodiment, the movement of the lock member 1002 in the first direction requires an axial pushing of the lock member 1002 in a direction perpendicular to the plane of the movement of the linkage 845.

In one embodiment, the second direction generally refers to a rightward side direction within the plane of the paper/page in FIG. 7. In one embodiment, the vector of the second direction (of motion) is in a plane parallel to the plane created by the movement (e.g., rotational motion) of the linkage. In one embodiment, the movement of the lock member 1002 in the second direction requires a lateral sliding of the lock member 1002 in the plane of the movement of the linkage 845.

In one embodiment, the lock member 1002 is configured to have more than one (or a single) degree of freedom. In one embodiment, this configuration of the lock member 1002 requires a user to axially push or depress the lock member 1002 and then laterally slide the lock member 1002 to engage or disengage the lock member 1002. This configuration, thus, prevents the lock member 1002 from accidently being engaged or disengaged. This configuration of the lock member also prevents accidental opening of the pliers 700.

Figure 13:
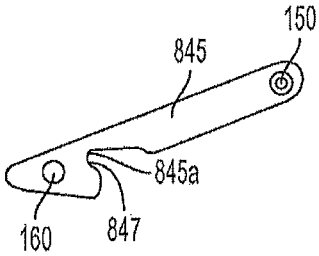
FIG. 13 shows a front elevational view of an overcenter linkage of the locking pliers in accordance with an embodiment of the present patent application.

In one embodiment, referring to FIG. 13, the linkage member 845 includes a lock member receiving recess 845*a*. In one embodiment, the lock member receiving recess 845*a* is constructed and arranged to receive a portion (1002*a*) of the lock member 1002, when the lock member 1002 is in its locking configuration. The portion 1002*a* and other portions of the lock member 1002 are described in detail below with respect to FIGS. 19-22.

In one embodiment, the lock member receiving recess 845*a* is shaped and sized such that its inner surface 847 is configured to engage with an outer surface of the portion 1002*a* of the lock member 1002. In one embodiment, the lock member receiving recess 845*a* and the portion 1002*a* of the lock member 1002 are shaped and sized to form a locking engagement to lock the lock member 1002 in its locking configuration.

Figure 14:
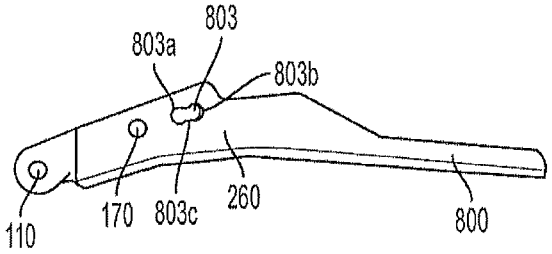
FIGS. 14 and 15 show a front elevational view and a close-up detailed view of a lower handle of the locking pliers in accordance with an embodiment of the present patent application.
Figure 15:
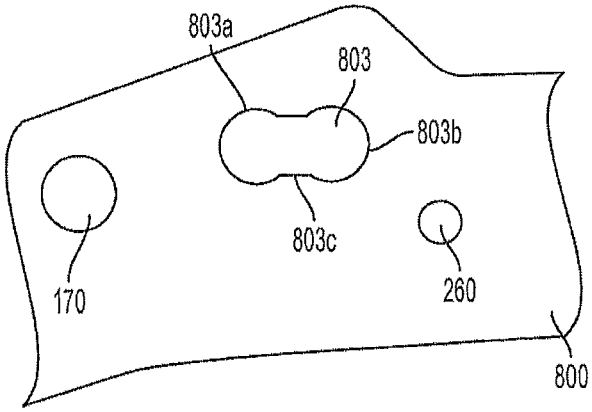

In one embodiment, referring to FIGS. 14 and 15, the lower handle 800 includes two elongated openings 803 that are axially aligned with each other. One of the elongated openings 803 is shown in FIGS. 14 and 15. In one embodiment, each of the elongated openings 803 of the lower handle 800 includes an hour glass shaped configuration. This configuration of the lower handle 800 enables the lock member 1002 to be located in either the locking configuration or the release configuration.

In one embodiment, each elongated opening 803 of the lower handle 800 includes opposing end openings 803*a* and 803*b* and a center opening 803*c* therebetween. Each of the opposing end openings 803*a* and 803*b* are enlarged relative to the center opening 803*c*. When the lock member 1002 is in the locking configuration, the lock member 1002 is received by one of the enlarged opposing end openings 803*a* of the lower handle 800 and the lock receiving recess 845*a* of the linkage 845. When the lock member 1002 is in the release configuration, the lock member 1002 is received by the other of the enlarged opposing end openings 803*b* of the lower handle 800.

In one embodiment, the lock member 1002 is configured to laterally slide between the locking configuration and the release configuration in the second direction. In one embodiment, the center opening 803*c* of the lower handle 800 is configured to facilitate the lateral sliding movement of the lock member 1002 between the locking configuration and the release configuration. That is, when the lock member 1002 is moved between the locking configuration and the release configuration, the lock member 1002 is configured to move from one of the end openings 803*a* and 803*b* to the other of the end openings 803*a* and 803*b* through the center opening 803*c* of the lower handle 800.

In one embodiment, the end openings 803*a* and 803*b* are constructed and arranged to receive the portion 1002*a* of the lock member 1002, when the lock member 1002 is either in its locking configuration or in its release configuration. In one embodiment, each of the end openings 803*a* and 803*b* is shaped and sized such that its inner surface is configured to engage with an outer surface of the portion 1002*a* of the lock member 1002. In one embodiment, each of the end openings 803*a* and 803*b* and the portion 1002*a* of the lock member 1002 are shaped and sized to form a locking engagement to lock the lock member 1002 in its locking configuration or in its release configuration.

In one embodiment, referring to FIGS. 19-24, the lock assembly 1000 includes the lock member 1002, a manually engageable member 1004 that is operatively associated with the lock member 1002, and a spring 1006. In one embodiment, the lock assembly 1000 may also include a washer 1008 and a movement limiting member or collar member 1012. The movement limiting member or collar member 1012 is described below in detail with respect to FIGS. 16-18.

In one embodiment, the lock member 1002 includes a first sized lock portion 1002*a* and a second sized lock portion 1002*b*. In one embodiment, the first and second sized lock portions 1002*a* and 1002*b* have different diameters. In one embodiment, the first sized lock portion 1002*a* of the lock member is a larger diameter lock portion and the second sized lock portion 1002*b* is a smaller diameter lock portion.

In one embodiment, the steps between the different sized or diameter portions 1002*a* and 1002*b* of the lock member 1002 are chamfered 1002*e* to prevent catching when the lock member 1002 travels axially in the first direction. In one embodiment, the lock member 1002 is constructed and arranged with varying diameter portions to provide interference between the lower handle 800 and the linkage 845 to prevent rotation between them.

The lock member 1002 is configured to extend through the lock member receiving recesses 803*a* of the lower handle 800 that are positioned to be in alignment with the lock member receiving recess 845*a* of the linkage member 845 when the linkage member 845 is in the overcenter jaw-closing position.

In one embodiment, the first sized lock portion 1002*a* of the lock member 1002 is shaped and sized such that its outer surface is configured to engage with inner surfaces of the lock member receiving recess 845*a* of the linkage member 845 and the end opening 803*a* of the lower handle 800, when the lock member 1002 is in locking configuration. In one embodiment, the first sized lock portion 1002*a* of the lock member 1002 is shaped and sized such that its outer surface is configured to engage with inner surfaces of the end opening 803*b* of the lower handle 800, when the lock member 1002 is in release configuration.

In one embodiment, the second sized lock portion 1002*b* of the lock member 1002 and the center opening 803*c* of the lower handle 800 are shaped and sized such that the second sized lock portion 1002*b* of the lock member 1002 laterally slides in the center opening 803*c* of the lower handle 800 when the lock member 1002 is moved between the locking configuration and the release configuration.

In one embodiment, the lock member 1002 may also include a third sized portion 1002*c* positioned adjacent the second sized lock portion 1002*b*, another second sized portion 1002*b*', a fourth sized portion 1002*d* and another first sized portion 1002*a*' between the fourth sized portion 1002*d* and the second sized portion 1002*b*'. In one embodiment, the third sized portion 1002*c* is positioned at one end of the lock member 1002 and the fourth sized portion 1002*d* is positioned at the other end of the lock member 1002. In one embodiment, the first sized lock portion 1002*a* is positioned between the second sized lock portion 1002*b* and the second sized portion 1002*b*'. In one embodiment, the second sized lock portion 1002*b* and the second sized portion 1002*b*' have same shape, size and cross-sectional configuration. In one embodiment, the first sized lock portion 1002*a* and the first sized portion 1002*a*' have same shape, size and cross-sectional configuration.

In one embodiment, the second sized portion 1002*b*' of the lock member 1002 and the rear, center opening 803*c* (that is axially aligned with the front, center opening 803*c* that receives the second sized lock portion 1002*b*) of the lower handle 800 are shaped and sized such that the second sized portion 1002*b*' of the lock member 1002 laterally slides in the corresponding rear, center opening 803*c* of the lower handle 800 when the lock member 1002 is moved between the locking configuration and the release configuration.

In one embodiment, the first sized portion 1002*a*' of the lock member 1002 and the rear, lock member receiving recesses 803*a*, 803*b* (that are axially aligned with the front, lock member receiving recesses 803*a*, 803*b* that receive the first sized lock portion 1002*a*) of the lower handle 800 are shaped and sized such that the first sized portion 1002*a*' of the lock member 1002 is received by one of the rear, lock member receiving recesses 803*a*, 803*b* when the lock member 1002 is in its locking configuration and is received by the other of the rear, lock member receiving recesses 803*a*, 803*b* when the lock member 1002 is in its release configuration. In one embodiment, each of the rear, lock member receiving recesses 803*a*, 803*b* of the lower handle 800 is shaped and sized such that its inner surface is configured to engage with an outer surface of the first sized portion 1002*a*' of the lock member 1002. In one embodiment, the rear, lock member receiving recesses 803*a*, 803*b* of the lower handle 800 and the first sized portion 1002*a*' of the lock member 1002 are shaped and sized to form a locking engagement to lock or maintain the lock member 1002 in its locking configuration or in its release configuration.

Figure 16:
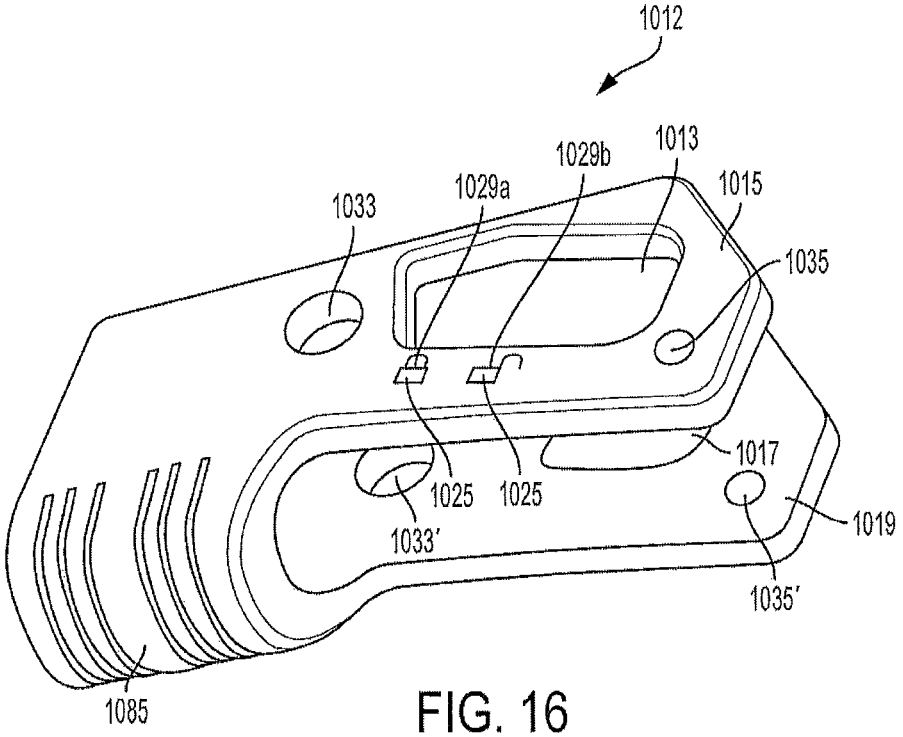
FIGS. 16-18 show a perspective view, a front elevational view and a rear elevational view of a collar member of the locking pliers in accordance with an embodiment of the present patent application.
Figure 17:
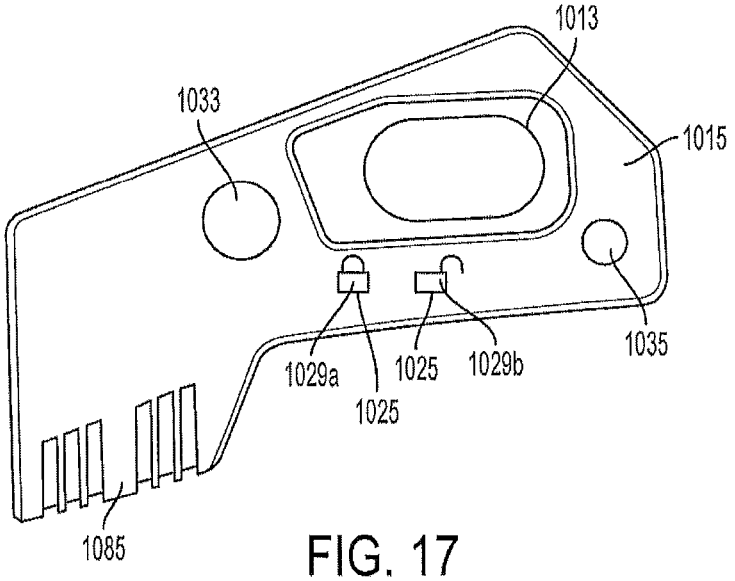
Figure 18:
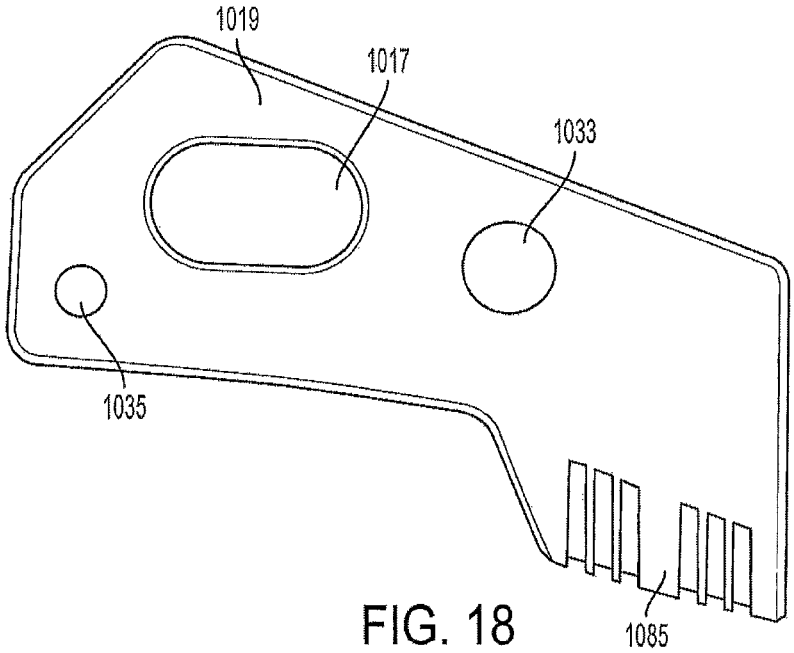
Figure 19:
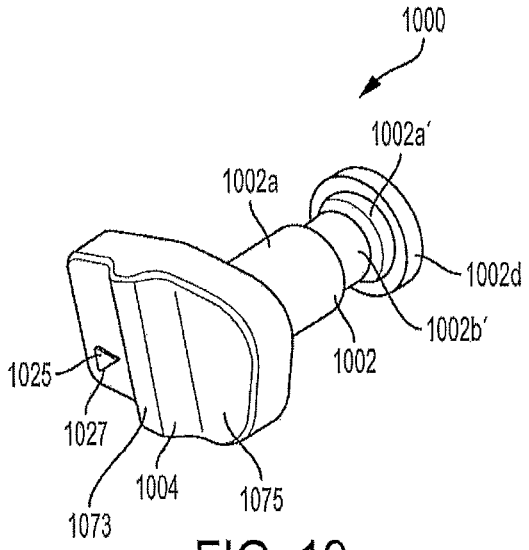
FIGS. 19 and 20 show an assembled view of a lock assembly of the locking pliers and a detailed view of the components of the lock assembly in accordance with an embodiment of the present patent application.
Figure 20:
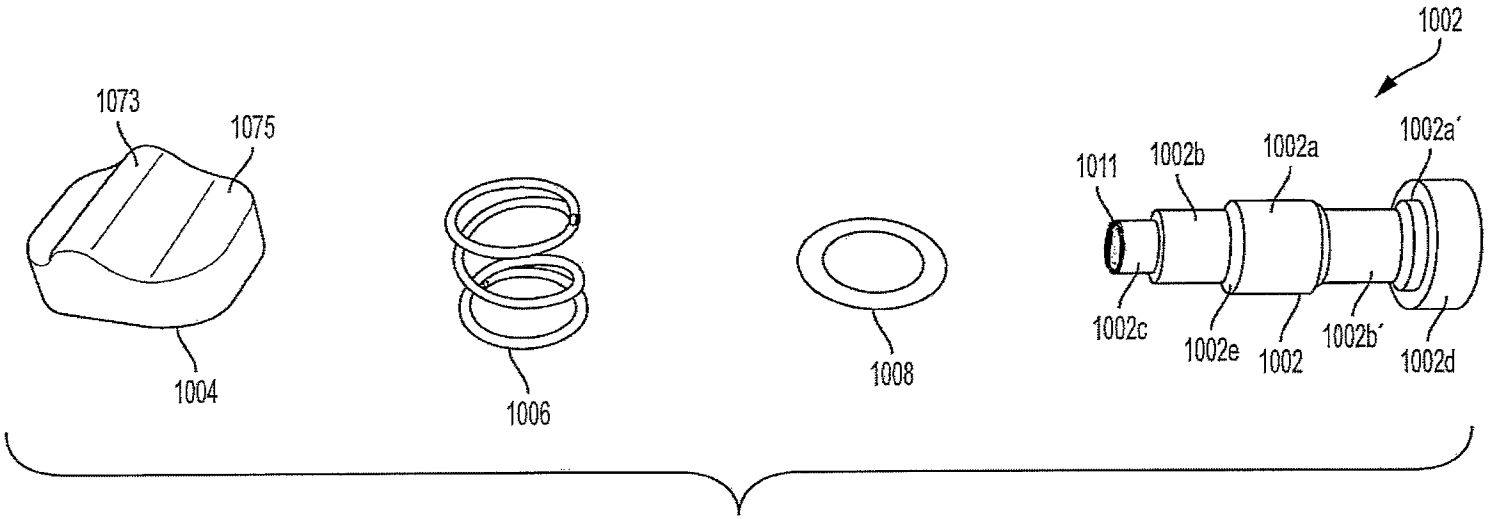
Figure 21:
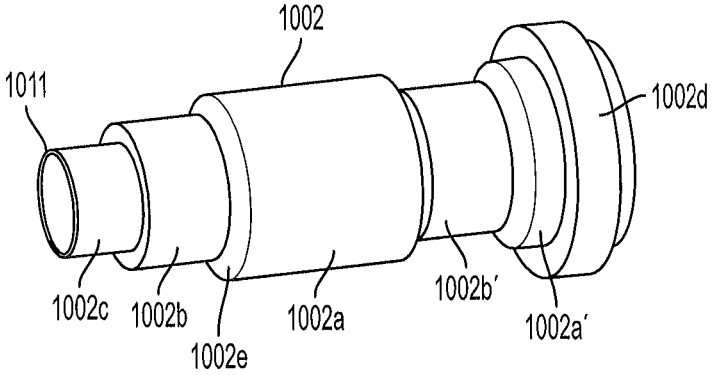
FIG. 21 shows a perspective view of a lock member of the lock assembly in accordance with an embodiment of the present patent application.

In one embodiment, the fourth sized portion 1002*d* of the lock member 1002 and an opening 1017 (as shown in FIGS. 16-18) of the collar member 1012 are shaped and sized such that the fourth sized portion 1002*d* of the lock member 1002 laterally slides in the opening 1017 of the collar member 1012 when the lock member 1002 is moved between the locking configuration and the release configuration.

Figure 23:
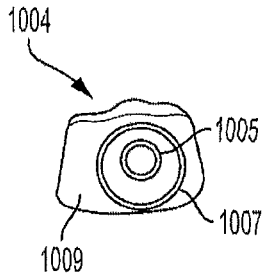
FIGS. 23, 23A and 24 show a rear elevational view, a perspective view and a front elevational view of a manually engageable member of the lock assembly in accordance with an embodiment of the present patent application.

In one embodiment, the third sized portion 1002*c* of the lock member 1002 is received by a recess 1005 (as shown in FIG. 23) disposed on a rear surface 1009 (as shown in FIG. 23) of the manually engageable member 1004 so as to operatively connect the lock member 1002 and the manually engageable member 1004. As the lock member 1002 and the manually engageable member 1004 are operatively connected to each other, actuation of the manually engageable member 1004 causes the movement of the lock member 1002.

In one embodiment, the manually engageable member 1004 is positioned on a first end 1011 of the lock member 1002. In one embodiment, the manually engageable member 1004 is configured to act as an actuator for the lock assembly 1000. In one embodiment, the manually engageable portion 1004 includes a recess 1007 on the rear surface 1009 thereof. In one embodiment, the recess 1007 of the manually engageable portion 1004 is configured to receive at least a portion of the spring 1006 so as to operatively connect the manually engageable portion 1004 to the spring 1006. In one embodiment, the manually engageable portion 1004 is operatively connected to both the spring 1006 and the lock member 1002.

Figure 23A:
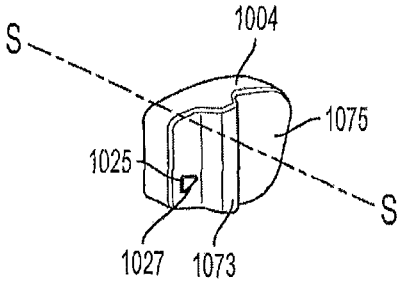
Figure 24:
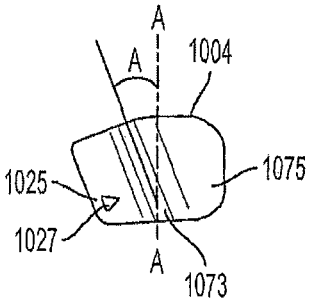
Figure 25:
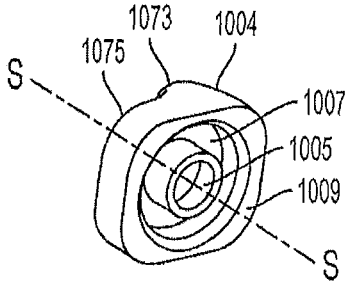
FIGS. 25, 25A and 26 show a rear perspective view, a front perspective view and a front elevational view of a manually engageable member of the lock assembly in accordance with another embodiment of the present patent application.
Figure 25A:
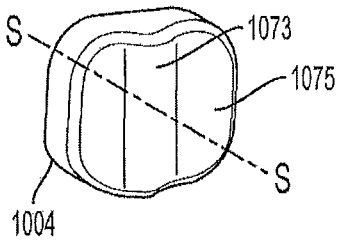
Figure 26:
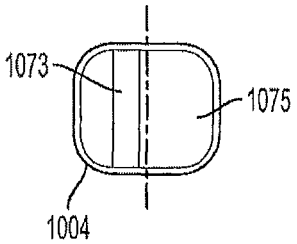

Referring to FIGS. 23-24, in one embodiment, the manually engageable member 1004 includes a non-axially symmetric configuration. In one embodiment, this non-axially symmetric configuration of the manually engageable member 1004 is more intuitive for an end user. In one embodiment, the manually engageable member 1004 is not axially symmetric with respect to an axis S-S (as shown in FIG. 23A). In one embodiment, the manually engageable member 1004 is not symmetric under 180 degree rotation about the axis S-S. In one embodiment, the manually engageable member 1004 includes a protrusion member 1073 (on a front surface 1075 of the manually engageable member 1004) that is constructed and arranged to provide comfort to a user during use and to be intuitive to use. In one embodiment, an angle A (as shown in FIG. 24) of the hump or the protrusion member 1073 with respect to an axis A-A is constructed and arranged to align more comfortably with the users thumb, when the manually engageable member 1004 is constrained by the movement limiting member or collar member 1012. FIGS. 25, 25A and 26 show views of another exemplary manually engageable member of the lock assembly. In one embodiment, the manually engageable member 1004 is also not axially symmetric about an axis S-S.

In one embodiment, this non-axially symmetric configuration of the manually engageable member 1004 (of FIGS. 23-24 and 25-26) enables the movement limiting member or collar member 1012 to restrict the rotation of the manually engageable member 1004. In one embodiment, this non-axially symmetric configuration of the manually engageable member 1004 (of FIGS. 23-24 and 25-26) also allows for the placement of the protrusion member 1073. In one embodiment, the protrusion member 1073 may be a humped feature that is constructed and arranged to provide comfort to a user during use and to be intuitive to use by the user.

Figure 27:
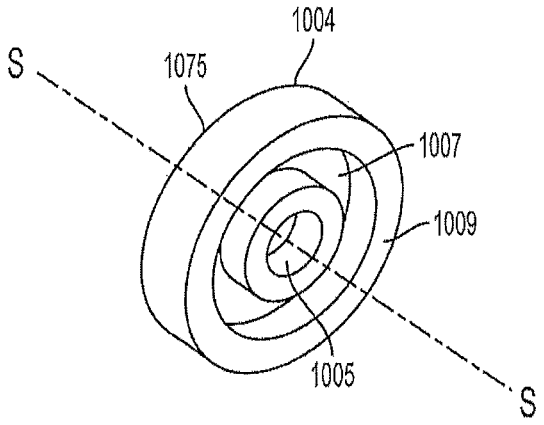
FIGS. 27 and 28 show a rear perspective view and a front perspective view of a manually engageable member of the lock assembly in accordance with yet another embodiment of the present patent application.
Figure 28:
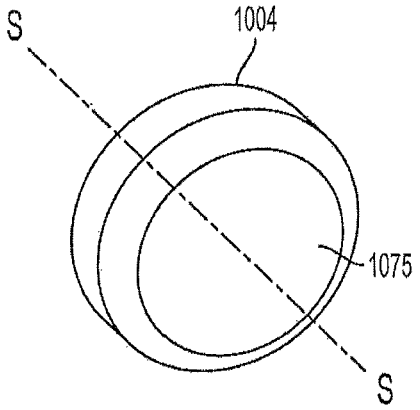

FIGS. 27 and 28 show views of yet another exemplary manually engageable member of the lock assembly. In one embodiment, the manually engageable member 1004 is axially symmetric about an axis S-S.

In one embodiment, the manually engageable member 1004 is constructed and arranged such that the user may manually actuate the manually engageable member 1004 to translate or move the lock member 1002 axially in the first direction, and then move the lock member 1002 in the second direction (i.e., radial direction). In one embodiment, the manually engageable member 1004 is configured to slide in the second direction and of a distance long enough to indicate clearly to the user whether the lock assembly is engaged or not.

In one embodiment, referring to FIGS. 10, 16, 17, 24, the lock assembly 1000 includes an indicator 1025 that configured to provide a first indication to indicate to the user when the lock member is in the locking configuration and a second indication to indicate to the user when the lock member is in the release configuration. In one embodiment, the first indication and the second indication are visual indications. In one embodiment, the indicator 1025 may include a first indicator portion 1027 and second indicator portions 1029*a* and 1029*b*. In one embodiment, the first indicator portion 1027 and the second indicator portion 1029*a* together provide the first indication to the user that the lock member is in the locking configuration. In one embodiment, the first indicator portion 1027 and the second indicator portion 1029*b* together provide the second indication to the user that the lock member is in the release configuration. In one embodiment, the first indicator portion 1027 is disposed on the manually engageable portion 1004 and the second indicator portions 1029*a* and 1029*b* are disposed on the collar member 1012.

Figure 22:
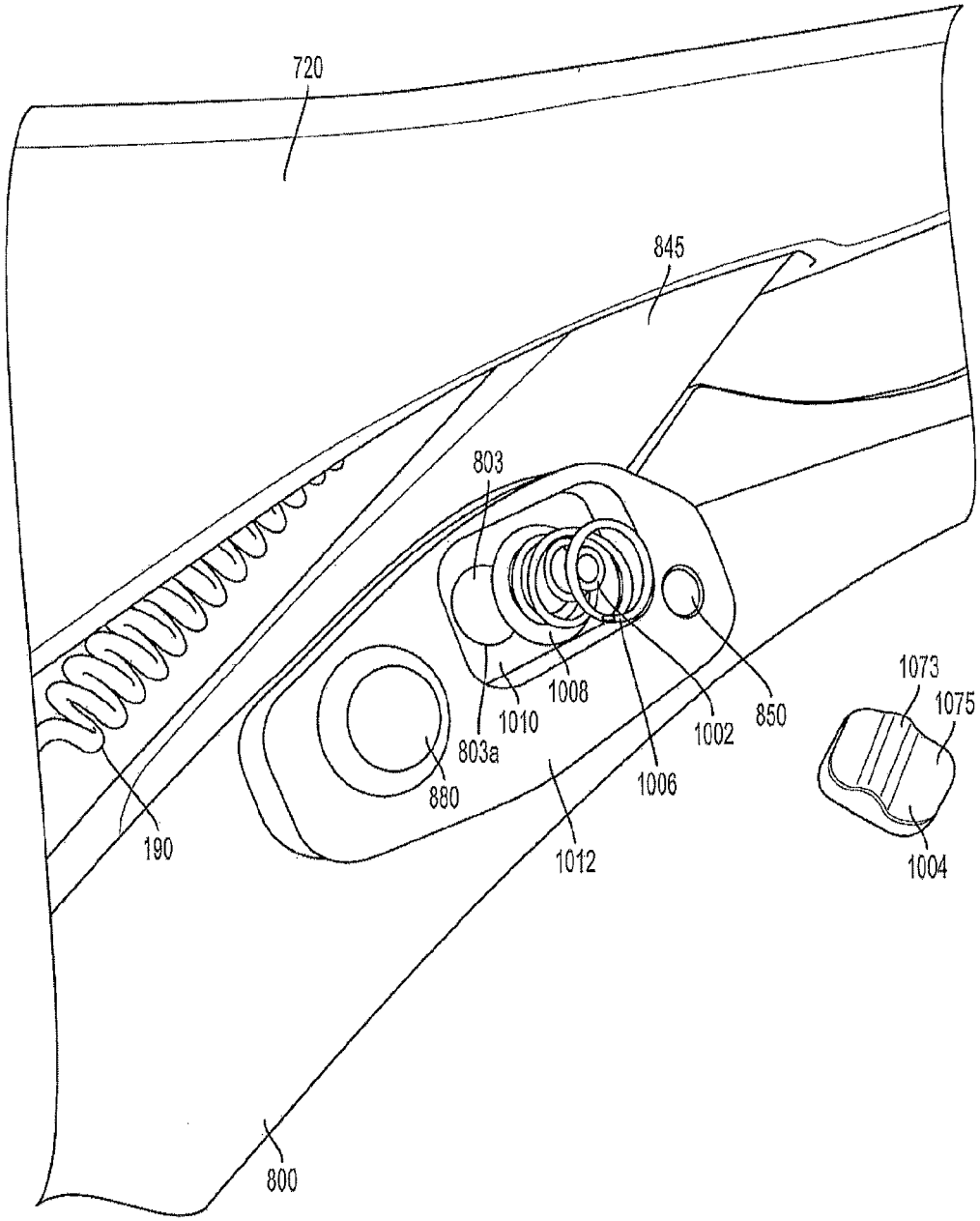
FIG. 22 shows a partially assembled view of the lock assembly in accordance with an embodiment of the present patent application.

In one embodiment, the indicator may be positioned on, for example, a surface 1010 (as shown in FIGS. 12 and 22) of the lower handle such the lateral sliding movement of the lock assembly to its locking configuration reveals the locking configuration indicator and the lateral sliding movement of the lock assembly to its release configuration reveals the release configuration indicator. For example, in one embodiment, the locking configuration indicator is positioned adjacent the lock member receiving recess 803*b* of the lower handle 800 and the release configuration indicator is positioned adjacent the lock member receiving recess 803*a* of the lower handle 800.

In one embodiment, the washer 1008 is provided in the lock assembly 1000 to distribute the load on the lock member 1002, reduce wear, or otherwise act as a spacer. It may be appreciated, however, that washers such as the washer 1008 are optional, and may be found associated with the other pivot pins, or may be omitted, across various embodiments. In one embodiment, when assembled in the lock assembly 1000, the washer member 1008 is positioned between the lower handle 800 and the spring 1006. In one embodiment, when assembled in the lock assembly 1000, the washer member 1008 is positioned to engage with the surface 1010 of the lower handle 800 on one side and to engage with a portion of the spring 1006 on the other side.

In one embodiment, referring to FIGS. 16-18, the movement limiting member or collar member 1012 is constructed and arranged to limit the movement or rotation of the manually engageable member 1004. In one embodiment, the movement limiting member or collar member 1012 is configured to allow the non-axially symmetric configuration of the manually engageable member 1004. In one embodiment, as shown in FIG. 22, the movement limiting member or collar member 1012 is configured to partially encase the manually engageable member 1004, the spring 1006, and/or the lock member 1002. In one embodiment, the movement limiting member or collar member 1012 is also configured to protect the manually engageable member 1004, the spring 1006, and/or the lock member 1002 from wear by partially encasing them.

In one embodiment, the movement limiting member or collar member 1012 includes openings 1033 and 1033' that are configured to be aligned with the second lower handle pivot holes 170 of the lower handle 800 and the lower linkage pivot hole 160 of the linkage member 845 and that are configured to receive the third pivot pin 880 therein. In one embodiment, the movement limiting member or collar member 1012 includes openings 1035 and 1035' that are configured to be aligned with third lower handle pivot holes 260 of the lower handle 800 and the release lever pivot hole 270 of the release lever 940 and that are configured to receive the release lever pivot pin 850 therein. In one embodiment, the pivot pins 880 and 850 are configured to connect the movement limiting member or collar member 1012 to the lower handle 800. In one embodiment, the movement limiting member or collar member 1012 may be optional.

In one embodiment, the movement limiting member or collar member 1012 includes an elongated opening 1013 on a front surface portion 1015 thereof and the elongated opening 1017 on a rear surface portion 1019 thereof. In one embodiment, the front elongated opening 1013 and the rear elongated opening 1017 have different shaped configurations. In one embodiment, the front elongated opening 1013 is constructed and arranged to receive a portion of the manually engageable member 1004 and the rear elongated opening 1017 is constructed and arranged to receive a portion of the fourth sized portion 1002*d* of the lock member 1002.

In one embodiment, the front elongated opening 1013 is shaped and sized to enable the Manually engageable member 1004 to laterally slide therethrough when the lock assembly 1000 moves between the locking and release configurations. In one embodiment, the rear elongated opening 1017 is shaped and sized to enable the fourth sized portion 1002*d* of the lock member 1002 to laterally slide therethrough when the lock assembly 1000 moves between the locking and release configurations.

In one embodiment, as shown in FIGS. 16-18, the movement limiting member or collar member 1012 may include a U-shaped member 1085 that is configured to surround a portion of the lower handle 800. In one embodiment, as shown in FIGS. 9, 12 and 22, the U-shaped member 1085 of the movement limiting member or collar member 1012 may be optional. For example, in one embodiment as shown in FIGS. 9, 12 and 22, the movement limiting member or collar member 1012 may include two separate members (a front and a rear member) that are not integrally formed. In one embodiment, the front and the rear members of the movement limiting member or collar member 1012 are connected to the lower handle 800 using the third pivot pin 880 and the release lever pivot pin 850. That is, as shown in FIGS. 9, 12 and 22, the movement limiting member or collar member 1012 does not include the U-shaped member 1085 (as shown in FIGS. 16-18). In one embodiment, the movement limiting member 1012 may be shaped and configured differently as may be seen by a comparison of the movement limiting member or collar member 1012 of FIG. 9 with that of FIGS. 12 and 22. In one embodiment, other movement limiting members or mechanisms may be used to limit the movement or rotation of the manually engageable member 1004.

In one embodiment, the spring 1006 is configured to provide a spring force to the lock assembly 1000 such that when the lock member 1002 is moved to its locking configuration, the spring force urges the lock member 1002 into its locking configuration in which the first sized lock portion 1002*a* of the lock member 1002 is received in a locking engagement by the lock member receiving recess 803*a* of the lower handle 800 and the lock member receiving recess 845*a* of the linkage 845. In one embodiment, the spring 1006 is configured to be positioned between the manually engageable member 1004 and a portion of the lower handle 800.

In one embodiment, the spring 1006 is configured to provide the spring force on the lock assembly 1000 such that when the lock member 1002 is moved to its release configuration, the spring force urges the lock member 1002 into its release configuration in which the first sized lock portion 1002*a* of the lock member 1002 is received in a locking engagement by the lock member receiving recess 803*b* of the lower handle 800.

In one embodiment, the spring 1006 is a spring member. In one embodiment, the spring 1006 is a coil or a helical spring member. In one embodiment, the spring 1006 is a compression spring.

In one embodiment, the spring 1006 is configured to maintain the lock member 1002 in an axially constrained position until a threshold force greater than a force of the spring 1006 is applied to the manually engageable member 1004. In one embodiment, the spring force provided by the spring 1006 is configured to impede the movement of the lock member 1002 from its locking configuration or its release configuration. In order to move the lock member 1002 from its locking configuration or its release configuration, the spring force of the spring 1006 must be overcome. In one embodiment, an application of a threshold force on the lock member 1002 in the first direction enables the lock member 1002 to overcome the spring force provided by the spring 1006. When the spring force is overcome, the lock member 1002 is configured to move between the locking configuration and the release configuration.

In one embodiment, the manually engageable member 1004 is biased forwardly (i.e., in the direction out of the plane of the paper in FIG. 7) by the spring 1006. In one embodiment, the spring 1006 is configured to function as a return spring. In one embodiment, the spring 1006 may be configured to function as a force transmitting mechanism for transmitting forces between the manually engageable member 1004 and the other components of the lock assembly 1000.

The operation of the pliers 700 is discussed with reference to FIGS. 7-12. As shown in FIGS. 7, 8 and 10, the lock member 1002 is in the locking configuration. When the lock member 1002 is in the locking configuration, the lock member 1002 is configured to prevent pivoting movement of the lower handle 800 from the closed configuration and retains the jaws 750 and 770 in the closed position. That is, when in the locking configuration, the lock member 1002 is configured to prevent the linkage member 845 from moving relative to the lower handle 800, and thus holding the linkage member 845 in the overcenter locked position.

Also, when in the locking configuration, the lock member 1002 is positioned such that the first sized lock portion 1002*a* is received in a locking engagement by both the lock member receiving recess 845*a* of the linkage member 845 and the lock member receiving recesses 803*a* of the lower handle 800. In one embodiment, when the larger diameter lock portion 1002*a* is positioned in the lock member receiving recess 845*a* of the linkage 845, the linkage 845 at least partially surrounds the larger diameter lock portion 1002*a*, preventing the linkage member 845 from moving out of the jaw-closing position due to the engagement between the lock member 1002 and the lock member receiving recess 845*a* of the linkage 845.

When the lock member 1002 is in its locking configuration, a spring force is applied on the manually engageable member 1004 by the spring 1006 in a direction out of the plane of the paper in FIG. 7. The applied spring force moves the manually engageable member 1004 in the direction out of the plane of the paper in FIG. 7. As the manually engageable member 1004 and the lock member 1002 are operatively connected to each other, the applied spring force also moves and positions the lock member 1002 such that the first sized lock portion 1002*a* is received in a locking engagement by both the lock member receiving recess 845*a* of the linkage member 845 and the lock member receiving recesses 803*a* of the lower handle 800.

In one embodiment, to move the lock member 1002 from its locking configuration, the user manually actuates the manually engageable member 1004 of the lock assembly 1000. In one embodiment, the manually engageable member 1004 of the lock assembly 1000 is manually actuated by the user to move the lock assembly 1000 in the first direction. In one embodiment, the manually engageable member 1004 of the lock assembly 1000 is manually actuated by the user to axially push of the lock assembly 1000 in a direction perpendicular to the plane of the movement of the linkage 845.

In one embodiment, application of a threshold force (by a user) on the manually engageable member 1004 in the first direction enables the manually engageable member 1004 to overcome the spring force provided by the spring 1006. In one embodiment, the threshold force is an axial force applied on the manually engageable member 1004.

When the spring force is overcome, the lock member 1002 may be (axially and) slidably positioned such that the smaller diameter lock portion 1002*b* is generally surrounded by the lock member receiving recess 845*a* of the linkage member 845. The linkage member 845 may freely move from the overcenter jaw-closing position, as the smaller diameter lock portion 1002*b* may pass through the lock member receiving recess 845*a* as the linkage bar 145 moves into and out of the overcenter jaw-closing position.

Also, depressing the manually engageable member 1004 causes the lock member 1002 to be axially or slidably positioned such that the smaller diameter lock portion 1002*b* is positioned in the end opening 803*a* of the lower handle 800 and the second diameter portion 1002*b*' is positioned in the rear, end opening 803*a* of the lower handle 800.

With the manually engageable member 1004 still being depressed, the user may laterally slide the manually engageable member 1004 in the second direction from the locking configuration to the release configuration. As the manually engageable member 1004 and the lock member 1002 are operatively connected to each other, the laterally sliding of the manually engageable member 1004 causes the laterally sliding movement of the lock member 1002.

During the lateral sliding movement of the lock member 1002 from the locking configuration to the release configuration, the second diameter lock portion 1002*b* is configured to slide through the center opening 803*c* of the lower handle 800. That is, the second diameter lock portion 1002*b* of the lock member 1002 is configured to move from the end opening 803*a* to the other end opening 803*b* through the center opening 803*c* of the lower handle 800. At the same time, the second diameter portion 1002*b*' of the lock member 1002 is configured to slide through the rear, center opening 803*c* of the lower handle 800.

When the second diameter lock portion 1002*b* of the lock member 1002 is received in the end opening 803*b* of the lower handle 800, the user may release the manually engageable member 1004. When the threshold force applied by the user on the manually engageable member 1004 is released, the spring force of the spring 1006 acts on the manually engageable member 1004 to push or force the manually engageable member 1004 in a direction out of the plane of the paper in FIG. 7. As the manually engageable member 1004 and the lock member 1002 are operatively connected to each other, the applied spring force also moves and (axially/slidably) positions the lock member 1002 such that the first sized lock portion 1002*a* is received in a locking engagement by the lock member receiving recesses 803*b* of the lower handle 800. Thus, the lock assembly 1000 is moved to its release configuration. The lock assembly 1000 remains in this release configuration until the user manually actuates the manually engageable member 1004 of the lock assembly 1000.

In one embodiment, to move the lock member 1002 from its release configuration, the user manually actuates (axially pushes it in the first direction) the manually engageable member 1004 of the lock assembly 1000.

In one embodiment, application of a threshold force (by a user) on the manually engageable member 1004 in the first direction enables the manually engageable member 1004 to overcome the spring force provided by the spring 1006. When the spring force is overcome, the lock member 1002 may be (axially and/or) slidably positioned such that the smaller diameter lock portion 1002*b* is positioned in the end opening 803*b* of the lower handle 800 and the second diameter portion 1002*b*' is positioned in the rear, end opening 803*b* of the lower handle 800.

With the manually engageable member 1004 still being depressed, the user may laterally slide the manually engageable member 1004 from the release configuration to the locking configuration in a direction (leftward side direction within the plane of the paper in FIG. 7) that is opposite to the second direction. During the lateral sliding movement of the lock member 1002 from the release configuration to the locking configuration, the second diameter lock portion 1002*b* of the lock member 1002 is configured to move from the end opening 803*b* to the other end opening 803*a* through the center opening 803*c* of the lower handle 800. At the same time, the second diameter portion 1002*b*' of the lock member 1002 is configured to slide through the rear, center opening 803*c* of the lower handle 800.

When the second diameter lock portion 1002*b* of the lock member 1002 is received in the end opening 803*a* of the lower handle 800, the user may release the manually engageable member 1004. When the threshold force applied by the user on the manually engageable member 1004 is released, the spring force of the spring 1006 acts on the manually engageable member 1004 to push or force the manually engageable member 1004 in a direction out of the plane of the paper in FIG. 7. The applied spring force also moves and (axially/slidably) positions the lock member 1002 such that the first sized lock portion 1002*a* is received in a locking engagement by both the lock member receiving recesses 803*a* of the lower handle 800 and the lock member receiving recess 845*a* of the linkage 845, preventing the linkage member 845 from moving out of the jaw-closing position. Thus, the lock assembly is moved to its locking configuration. The lock assembly 1000 remains in this locking configuration until the user manually actuates the manually engageable member 1004 of the lock assembly 1000.

Although the patent application has been described in detail for the purpose of illustration based on what is currently considered to be the most practical and preferred embodiments, it is to be understood that such detail is solely for that purpose and that the patent application is not limited to the disclosed embodiments, but, on the contrary, is intended to cover modifications and equivalent arrangements that are within the spirit and scope of the appended claims. For example, it is to be understood that the present patent application contemplates that, to the extent possible, one or more features of any embodiment can be combined with one or more features of any other embodiment.

What is claimed is:

1. A pair of pliers comprising:

an upper structure including an upper jaw and an upper handle extending from the upper jaw;

a lower structure including a lower jaw and a lower handle, the lower jaw being configured to pivot relative to the upper jaw, and the lower handle being configured to pivot relative to the lower jaw;

an overcenter linkage operatively connected between the upper structure and the lower structure, the linkage biasing the lower handle and the lower jaw away from the upper handle and the upper jaw, respectively, when in a jaw-opening position, and enabling the lower jaw and the lower handle to be retained in a closed configuration when the linkage is in a jaw-closing position; and a lock member comprising a unitary member that is movable between a locking configuration and a release configuration, wherein when the lock member is in the locking configuration it prevents pivoting movement of the lower handle from the closed configuration and retains the jaws in a closed position, and wherein when the lock member is in the release configuration, it enables the lower handle to be moved away from the closed configuration and allows the jaws to move to an open position;

wherein movement of the lock member from the locking configuration to the release configuration requires sequential movement of the lock member in a first direction and then in a second direction, wherein the second direction is different than the first direction.

2. The pliers of claim 1, wherein the first direction and the second direction are perpendicular to one another.

3. The pliers of claim 1, wherein the first direction is a direction perpendicular to a plane of movement of the linkage.

4. The pliers of claim 1, wherein the second direction is in a plane parallel to a plane of movement of the linkage.

5. The pliers of claim 1, wherein the movement of the lock member in the first direction requires an axial pushing of the lock member in a direction perpendicular to a plane of movement of the linkage.

6. The pliers of claim 1, further comprising a spring, wherein application of a threshold force on the lock member in the first direction enables the lock member to overcome a spring force, provided by the spring, that impedes movement of the lock member from its locking configuration.

7. The pliers of claim 6, wherein the spring force, provided by the spring, impedes movement of the lock member from its release configuration.

8. The pliers of claim 7, wherein when the spring force is overcome, the lock member is configured to move between the locking configuration and the release configuration.

9. The pliers of claim 8, wherein the lower handle includes an elongate opening having opposing end openings and a center opening therebetween, wherein each of the opposing end openings are enlarged relative to the center opening, and wherein when the lock member is in the locking configuration, the lock member is received by one of the enlarged opposing end openings and a lock receiving recess of the linkage and when the lock member is in the release configuration, the lock member is received by the other of the enlarged opposing end openings.

10. The pliers of claim 1, further comprising a spring that is configured to provide a spring force on the lock member such that when the lock member is moved to its locking configuration, the spring force urges the lock member into its locking configuration in which the lock member is received by a lock member receiving recess of the lower handle and a lock member receiving recess of the linkage.

11. The pliers of claim 10, wherein the spring is configured to provide the spring force on the lock member such that when the lock member is moved to its release configuration, the spring force urges the lock member into its release configuration in which the lock member is received by another lock member receiving recess of the lower handle.

12. The pliers of claim 1, wherein the lock member includes a larger sized lock portion and a smaller sized lock portion, and wherein, when in the locking configuration, the lock member is positioned such that the larger diameter lock portion is received in a lock member receiving recess of the linkage and a lock member receiving recess of the lower handle.

13. The pliers of claim 12, wherein, when the larger diameter lock portion is positioned in the lock member receiving recess of the linkage, the linkage surrounds the larger diameter lock portion, preventing the linkage from moving out of the jaw-closing position due to the engagement between the lock member and the lock member receiving recess of the linkage.

14. The pliers of claim 1, further comprising indicator configured to provide a first indication to indicate to a user when the lock member is in the locking configuration and a second indication to indicate to the user when the lock member is in the release configuration.

15. The pliers of claim 14, wherein the first indication and the second indication are visual indications.

16. The pliers of claim 1, further comprising a manually engageable member that is operatively associated with the lock member and that is manually actuatable to move the lock member in the first and second direction.

17. The pliers of claim 16, wherein the manually engageable portion includes a non-axially symmetric configuration.

18. The pliers of claim 17, further comprising a movement limiting member that is constructed and arranged to limit movement or rotation of the manually engageable member.

19. The pliers of claim 18, wherein the manually engageable portion includes an angled protrusion on a surface thereof, and wherein the angled protrusion is constructed and arranged to align more comfortably with a user's thumb, when the manually engageable member is constrained by the movement limiting member.

20. A pair of pliers comprising:

an upper structure including an upper jaw and an upper handle extending from the upper jaw;

a lower structure including a lower jaw and a lower handle, the lower jaw being configured to pivot relative to the upper jaw, and the lower handle being configured to pivot relative to the lower jaw;

an overcenter linkage operatively connected between the upper structure and the lower structure, the linkage biasing the lower handle and the lower jaw away from the upper handle and the upper jaw, respectively, when in a jaw-opening position, and enabling the lower jaw and the lower handle to be retained in a closed configuration when the linkage is in a jaw-closing position; and a lock member movable between a locking configuration and a release configuration, wherein when the lock member is in the locking configuration it prevents pivoting movement of the lower handle from the closed configuration and retains the jaws in a closed position, and wherein when the lock member is in the release configuration, it enables the lower handle to be moved away from the closed configuration and allows the jaws to move to an open position;

wherein movement of the lock member from the locking configuration to the release configuration requires sequential movement of the lock member in a first direction and then in a second direction, wherein the second direction is different than the first direction, and wherein the movement of the lock member in the second direction requires a lateral sliding of the lock member in a plane parallel to a plane of movement of the linkage.

21. A pair of pliers comprising:

an upper structure including an upper jaw and an upper handle extending from the upper jaw;

a lower structure including a lower jaw and a lower handle, the lower jaw being configured to pivot relative to the upper jaw, and the lower handle being configured to pivot relative to the lower jaw;

an overcenter linkage operatively connected between the upper structure and the lower structure, the linkage biasing the lower handle and the lower jaw away from the upper handle and the upper jaw, respectively, when in a jaw-opening position, and enabling the lower jaw and the lower handle to be retained in a closed configuration when the linkage is in a jaw-closing position; and a lock member movable between a locking configuration and a release configuration, wherein when the lock member is in the locking configuration it prevents pivoting movement of the lower handle from the closed configuration and retains the jaws in a closed position, and wherein when the lock member is in the release configuration, it enables the lower handle to be moved away from the closed configuration and allows the jaws to move to an open position;

wherein movement of the lock member from the locking configuration to the release configuration requires sequential movement of the lock member in a first direction and then in a second direction, wherein the second direction is different than the first direction, and wherein the movement of the lock member in the first direction requires an axial pushing of the lock member and the movement of the lock member in the second direction requires a lateral sliding of the lock member.

* * * * *